US009319794B2

(12) United States Patent
Betlehem et al.

(10) Patent No.: US 9,319,794 B2
(45) Date of Patent: Apr. 19, 2016

(54) SURROUND SOUND SYSTEM

(75) Inventors: Terence Betlehem, Lower Hutt (NZ); Mark Alistair Poletti, Lower Hutt (NZ)

(73) Assignee: Industrial Research Limited, Lower Hutt (NZ)

( * ) Notice: Subject to any disclaimer, the term of this patent is extended or adjusted under 35 U.S.C. 154(b) by 422 days.

(21) Appl. No.: 13/817,945

(22) PCT Filed: Aug. 22, 2011

(86) PCT No.: PCT/NZ2011/000161
§ 371 (c)(1),
(2), (4) Date: May 16, 2013

(87) PCT Pub. No.: WO2012/023864
PCT Pub. Date: Feb. 23, 2012

(65) Prior Publication Data

US 2013/0223658 A1 Aug. 29, 2013

(30) Foreign Application Priority Data

Aug. 20, 2010 (NZ) ..... 587483

(51) Int. Cl.
*H04S 3/00* (2006.01)
*H04R 5/02* (2006.01)
*G10L 19/008* (2013.01)

(52) U.S. Cl.
CPC *H04R 5/02* (2013.01); *H04S 3/002* (2013.01); *G10L 19/008* (2013.01)

(58) Field of Classification Search
CPC ..... H04S 3/002; H04R 5/02
USPC ..... 381/307
See application file for complete search history.

(56) References Cited

U.S. PATENT DOCUMENTS 5,142,586 A * 8/1992 Berkhout ..... 381/63
5,199,075 A 3/1993 Fosgate (Continued)

FOREIGN PATENT DOCUMENTS

WO 03/073791 9/2003
WO 2004/068463 8/2004
WO 2005/013643 2/2005

OTHER PUBLICATIONS

Terence Betlehem et al., "Theory and design of sound field reproduction in reverberant rooms," J. Acoust. Soc. Am. vol. 117, No. 4, Apr. 2005, pp. 2100-2111.
M. Poletti et al., "Sound-field reproduction systems using fixed-directivity loudspeakers," J. Acoust. Soc. Am. vol. 127, No. 6, Jun. 2010, pp. 3590-3601.
Michael Chapman et al., "A Standard for Interchange of Ambisonic Signal Sets Including a file standard with metadata," Ambisonics Symposium, Jun. 25-27, 2009 pp. 1-6.
Mark Poletti, "Unified Description of Ambisonics Using Real and Complex Spherical Harmonics", Ambisonics Symposium, Jun. 25-27, 2009, pp. 1-10.

(Continued)

*Primary Examiner* — Sonia Gay
(74) *Attorney, Agent, or Firm* — Dann, Dorfman, Herrell and Skillman, P.C.

(57) ABSTRACT

A surround sound system for reproducing a spatial sound field in a sound control region within a room having at least one sound reflective surface. The system uses multiple steerable loudspeakers located about the sound control region, each loudspeaker having a plurality of different individual directional response channels being controlled by respective speaker input signals to generate sound waves emanating from the loudspeaker with a desired overall directional response. A control unit connected drives each of the loudspeakers and has pre-configured filters based on measured acoustic transfer functions for the room for filtering the input spatial audio signals to generate the speaker input signals for all the loudspeakers to generate sound waves with coordinated overall directional responses that combine together at the sound control region in the form of either direct sound or reflected sound from the reflective surface(s) of the room to reproduce the spatial sound field.

33 Claims, 11 Drawing Sheets

(56) References Cited

U.S. PATENT DOCUMENTS

| | | | | |
|---|---|---|---|---|
| 5,809,150 | A | 9/1998 | Eberbach | |
| 5,870,484 | A | 2/1999 | Greenberger | |
| 7,092,541 | B1 | 8/2006 | Eberbach | |
| 7,133,530 | B2 | 11/2006 | Poletti | |
| 7,515,719 | B2 | 4/2009 | Hooley et al. | |
| 7,577,260 | B1 * | 8/2009 | Hooley et al. | 381/77 |
| 8,594,350 | B2 * | 11/2013 | Hooley et al. | 381/307 |
| 2006/0072773 | A1 | 4/2006 | Hughes, II et al. | |
| 2006/0165247 | A1 | 7/2006 | Mansfield et al. | |
| 2006/0222191 | A1 | 10/2006 | Hung et al. | |
| 2007/0041599 | A1 | 2/2007 | Gauthier et al. | |
| 2007/0263889 | A1 | 11/2007 | Melanson | |
| 2008/0101631 | A1 | 5/2008 | Jung et al. | |
| 2009/0060236 | A1 * | 3/2009 | Johnston et al. | 381/304 |
| 2009/0103753 | A1 | 4/2009 | Hsu | |
| 2009/0214046 | A1 * | 8/2009 | Suzuki et al. | 381/17 |
| 2009/0271005 | A1 * | 10/2009 | Christensen | G10L 21/00 700/19 |

OTHER PUBLICATIONS

Marinus M. Boone et al., "Design of a Loudspeaker System with a Low-Frequency Cardioidlike Radiation Pattern," J. Audio Eng. Soc., vol. 45, No. 9, Sep. 1997, pp. 702-707.

Laura Fuster et al., "Room Compensation using Multichannel Inverse Filters for Wave Field Synthesis Systems," AES Convention Paper 6401, 118th Convention, May 28-31, 2005, Barcelona, Spain, pp. 1-9.

M.A. Poletti, "Three-Dimensional Surround Systems Based on Spherical Harmonics," J. Audio Eng. Soc., vol. 53, No. 11, Nov. 2005, pp. 1004-1025.

Alexander Mattioli Pasqual et al., "Application of Acoustic Radiation Modes in the Directivity Control by a Spherical Loudspeaker Array," Acta Acoustics United with Acustica, vol. 96, 2010, pp. 32-42.

Peter Kassakian et al., "Characterization of Spherical Loudspeaker Arrays," AES Convention Paper 6283, 117th Convention, Oct. 28-31, 2004, San Francisco, CA, pp. 1-16.

* cited by examiner

SURROUND SOUND SYSTEM

FIELD OF THE INVENTION

The present invention relates to a surround sound system for reproducing a spatial sound field within a room.

BACKGROUND TO THE INVENTION

In home theatre, typical surround sound is performed using 5 or 7 loudspeakers plus a subwoofer, such as in the Dolby surround format. Such surround sound systems are able to create direct fields from various directions and ambient (diffuse) fields, but they cannot perform a full ambisonics reproduction that is required to recreate a sound over a spatial area or volume.

The more high-end and complex ambisonics surround sound systems typically require a large circular or spherical arrangement of loudspeaker drivers surrounding the sound control region to reproduce a spatial sound field. However, the requirement for such large arrays of loudspeakers is not compatible with the demands for compact surround sound systems in home theatre and entertainment systems.

A fundamental challenge to sound field control is the presence of room reverberation. Many current surround sound systems simply ignore the presence of room reverberation, although there are some possibilities for avoiding reverberation or cancelling reverberation outside the sound control region [4-8,22]

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved compact surround sound system that is capable of reproducing spatial sound fields with a reduced number loudspeakers, or to at least provide the public with a useful choice.

SUMMARY OF THE INVENTION

In a first aspect, the present invention broadly consists in a surround sound system for reproducing a spatial sound field in a sound control region within a room having at least one sound reflective surface, comprising: multiple steerable loudspeakers located about the sound control region, each loudspeaker having a plurality of different individual directional response channels being controlled by respective speaker input signals to generate sound waves emanating from the loudspeaker with a desired overall directional response created by a combination of the individual directional responses; and a control unit connected to each of the loudspeakers and which receives input spatial audio signals representing the spatial sound field for reproduction in the sound control region, the control unit having pre-configured filters for filtering the input spatial audio signals to generate the speaker input signals for all the loudspeakers to generate sound waves with co-ordinated overall directional responses that combine together at the sound control region in the form of either direct sound or reflected sound from the reflective surface(s) of the room to reproduce the spatial sound field, the filters being pre-configured based on acoustic transfer function data representing the acoustic transfer functions measured in the sound control region from the individual directional responses of each of the loudspeakers at their respective locations in the room.

Preferably, the input spatial audio signals may be in an ambisonics-encoded surround format that is received and directly filtered by the filters in the control unit to generate the speaker input signals for the loudspeakers. Alternatively, the input spatial audio signals may be in a non-ambisonics surround format and the control unit further comprises a converter that is configured to convert the non-ambisonics input signals into an ambisonics surround format for subsequent filtering by the filters in the control unit to generate the speaker input signals for the loudspeakers.

Preferably, the control unit may be switchable between a configuration mode in which the control unit configures the filters for the room and a playback mode in which the control unit processes the input spatial audio signals for reproduction of the spatial sound field using the loudspeakers.

Preferably, the control unit may comprise a configuration module that is arranged to automatically configure the filters in the configuration mode based on input acoustic transfer function data for the room that is measured by a sound field recording system.

Preferably, the input acoustic transfer function data for the room may be measured by a sound field recording system comprising a microphone array located in the sound control region and the acoustic transfer function data represents the acoustic transfer functions measured by the microphone array in response to test signals generated by each of the loudspeakers for each of their directional responses. More preferably, the configuration module may receive raw measured acoustic transfer function data from the sound field recording system and converts it into an ambisonics representation of the acoustic transfer function data which is used to configure the filters of the control unit.

Preferably, the filters of the control unit may be ambisonics loudspeaker filters.

In one form, the surround sound system may be configured to provide a 2-D spatial sound field reproduction in a 2-D sound control region. Preferably, the sound control region may be circular and has a predetermined diameter. More preferably, the sound control region may be located in a horizontal plane and the loudspeakers are at least partially co-planar with the sound control region.

Preferably, each loudspeaker may be located within a respective loudspeaker location region, the room being radially and equally segmented into loudspeaker location regions about the origin of the sound control region based on the number of loudspeakers, and wherein each loudspeaker region is defined to extend between a pair of radii boundary lines extending outwardly from the origin of the sound control region. Preferably, the angular distance between each pair of radii boundary lines may correspond to 360°/L, where L is the number of loudspeakers.

Preferably, each loudspeaker may be spaced apart from every other loudspeaker by at least half of a wavelength of the lowest frequency of the operating frequency range of the surround sound system. This condition will ensure de-correlated room excitations above the Schroeder frequency.

Preferably, each loudspeaker may be spaced apart from any reflective surface(s) in the room by at least quarter of a wavelength of the lowest frequency of the operating frequency range of the surround sound system.

Preferably, each loudspeaker may be spaced at least 0.5 m from the perimeter of the sound control region. More preferably, each loudspeaker may be spaced at least 1 m from the perimeter of the sound control region.

Preferably, each loudspeaker may be configured to generate overall directional responses having up to $M^{th}$ order directivity patterns, where M is at least 1. More preferably, each loudspeaker may be configured to generate overall directional responses having up to $M^{th}$ order directivity patterns, wherein M is equal to 4. Typically, the value 2M+1 corresponds to the number of individual directional response channels available for each loudspeaker.

Preferably, each loudspeaker comprises at least an individual directional response channel corresponding to a first order directional response.

In one form, each loudspeaker may comprise at least individual directional response channels corresponding to 2M+1 phase mode directional responses.

In a preferred form, each loudspeaker may comprise at least individual directional response channels corresponding to an omni-directional response, and $\cos(m\phi)$ and $\sin(m\phi)$ for m=1, 2, . . . , M, and where $\phi$ is equal to the desired angular direction of the loudspeaker overall directional response relative to the origin of the loudspeaker.

Preferably, the overall directional response of each loudspeaker may be steerable in 360° relative to the origin of the loudspeaker.

Preferably, each loudspeaker may comprise multiple drivers configured in a geometric arrangement within a single housing, each driver being driven by a driver signal to generate sound waves, and wherein each loudspeaker further comprises a beamformer module that may be configured to receive and process the speaker input signals corresponding to the individual directional response channels of the loudspeaker and which generates driver signals for driving the loudspeaker drivers to create an overall sound wave having the desired overall directional response.

Preferably, each loudspeaker may comprise a housing within which a uniform circular array of monopole drivers of a predetermined radius are mounted, and wherein the number of drivers and radius may be selected based on the desired maximum order of directivity pattern required for the loudspeaker. More preferably, the monopole drivers may be spaced apart from each other by no more than half a wavelength of the maximum frequency of the operating frequency range of the surround sound system.

Preferably, the surround sound system may comprise at least four steerable loudspeakers.

Preferably, the control unit may be configured to automatically step-up the order of the directivity patterns of the overall directional responses of the loudspeakers as the frequency of the spatial sound field represented by input spatial audio signals increases to thereby maintain a substantially constant size of sound control region.

Preferably, the control unit may be configured to automatically step-up the order of the directivity pattern of the overall directional responses of the loudspeakers at predetermined frequency thresholds in the operating frequency range of the surround sound system, the thresholds being determined based on the number of loudspeakers and the desired size of sound control region.

Preferably, the loudspeakers may be equi-spaced relative to each other about the sound control region. More preferably, the loudspeakers may be sparsely located about the sound control region. Preferably, each loudspeaker may be located near a reflective surface, such as a wall in the room or in the vicinity of a corner of the room.

Preferably, the spatial sound field may be represented in the sound control region by direct sound in combination with first order, second order, and/or higher order reflections from sound waves reflected off one or more reflective surfaces of the room.

Preferably, the surround sound system may be configurable to reproduce higher order ambisonics spatial sound fields.

Preferably, the diameter of the sound control region may be at least 0.175 m. Typically, the diameter of the sound control region may be in the range of about 0.175 m to about 1 m.

In another form, the surround sound system may be configured to provide a 3-D spatial sound field reproduction in a 3-D sound control region. More preferably, the 3-D sound control region may be spherical in shape.

It will be appreciated that other shapes of 2-D and 3-D sound control regions could alternatively be used, but typically using a sound control region that is a circular (spherical) shape in 2-D (3-D) is most efficient due to the physics regarding sound field reproduction.

In a second aspect, the present invention broadly consists in an audio device for driving multiple steerable loudspeakers to reproduce a spatial sound field in a sound control region, each loudspeaker having a plurality of different individual directional response channels being controlled by respective speaker input signals to generate sound waves emanating from the loudspeaker with a desired overall directional response created by a combination of the individual directional responses, and where the loudspeakers are located about a sound control region in a room having at least one sound reflective surface, the device comprising: an input interface for receiving input spatial audio signals representing a spatial sound field for reproduction in the sound control region; a filter module comprising filters that are configurable based on acoustic transfer function data representing the acoustic transfer functions measured in the sound control region from the individual directional responses of each of the loudspeakers at their respective locations in the room, and which filter the input spatial audio signals to generate speaker input signals for all the loudspeakers to generate sound waves with co-ordinated overall directional responses that combine together at the sound control region in the form of either direct sound or reflected sound from the reflective surface(s) of the room to reproduce the spatial sound field; and an output interface for connecting to all the loudspeakers and for sending the speaker input signals to the loudspeakers.

In one form, the input interface may be configured to receive input spatial audio signals in an ambisonics-encoded surround format for direct filtering by the filters of the filter module to generate the speaker input signals for the loudspeakers.

In another form, the input interface may be configured to receive input spatial audio signals in a non-ambisonics surround format and which further comprises a converter that is configured to convert the non-ambisonics input signals into an ambisonics surround format for subsequent filtering by the filters of the filter module to generate the speaker input signals for the loudspeakers.

Preferably, the device may be switchable between a configuration mode in which the device configures the filters of the filter module for the room and a playback mode in which the device processes the input spatial audio signals for reproduction of the spatial sound field using the loudspeakers.

Preferably, the device may further comprise a configuration module that is arranged to automatically configure the filters of the filter module in the configuration mode based on input acoustic transfer function data for the room that is measured by a sound field recording system.

Preferably, the input acoustic transfer function data for the room may be measured by a sound field recording system comprising a microphone array located in the sound control region and the acoustic transfer function data represents the acoustic transfer functions measured by the microphone array in response to test signals generated by each of the loudspeakers for each of their directional responses.

Preferably, the configuration module may receive raw measured acoustic transfer function data from the sound field recording system and converts it into an ambisonics representation of the acoustic transfer function data which is used to configure the filters of the filter module.

Preferably, the filters of the filter module may be ambisonics loudspeaker filters.

The second aspect of the invention may have any one or more of the features mentioned in respect of the first aspect of the invention.

The phrase "direct sound" in this specification and claims is intended to mean sound waves propagating directly from the loudspeaker into the sound control region without reflection of any reflective surfaces.

The phrase "reflected sound" in this specification and claims is intended to mean sound waves propagating indirectly from the loudspeaker into the sound control region after being reflected off one or more reflective surfaces, whether $1^{st}$ order reflections, $2^{nd}$ order reflections, or higher order reflections, such that the sound waves appear to be arriving from virtual sound sources not corresponding to the loudspeakers.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

1. Overview

The present invention relates to a surround sound system for reproducing a spatial sound field in a room, typically for domestic home entertainment systems. The surround sound system is scalable to suit rooms of varying size and shape. Typically the room is substantially enclosed by a floor and ceiling, and comprises at least one but preferably multiple sound reflective or reverberant surfaces, typically provided by a wall(s) defining the room or other vertical surface adjoining the floor and ceiling. The levels of reverberation are measured by the critical reverberation distance which represents the distance from a source at which the reverberant and direct sound energies are equal. In an average living room or bedroom, this distance is typically 50 cm to 1 meter. Any further than the critical reverberation distance, sound energy is dominated by the reverberation.

Figure 1:
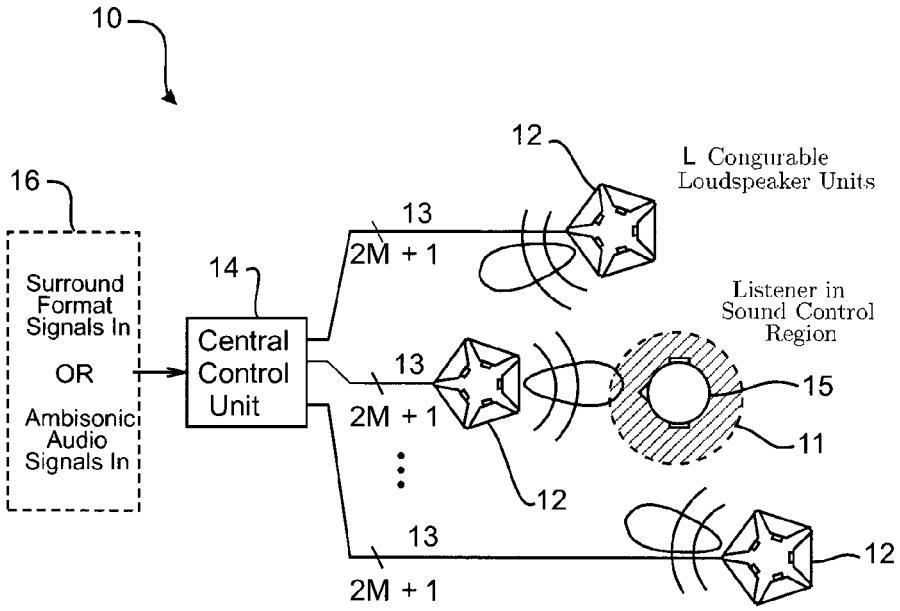
FIG. 1 is a schematic diagram of the surround sound system in accordance with an embodiment of the invention, in playback mode.

In brief, the surround sound system is configured to generate spatial or surround sound by creating the impression that sound is coming from one or more intended directions. Referring to FIG. 1, the system comprises a small array of configurable loudspeaker units 12 that surround or are located in a spaced-apart geometric arrangement, random or organized, about a sound control region 11 in the room within which the listener or listeners 15 are located. In this embodiment, all the loudspeakers are located relative to the sound control region such that they at least have a direct sound path to the sound control region. The loudspeakers 12 are each configurable or steerable in that they have variable directional responses that can be controlled by the speaker input signals 13 which control them. The system further comprises a control system or unit 14 that generates the speaker input signals for driving all the loudspeakers 12 in a co-ordinated manner to generate sound waves with particular directional responses that combine together in the sound control region 11 to reproduce a spatial sound field in that region based on an input audio spatial signal 16 representing the spatial sound field to be reproduced. The central control unit is configured to use all loudspeakers in reproducing the spatial sound field by utilising direct sound waves directed into the sound control region from one or more of the loudspeakers in combination with reflected or reverberant sound waves directed into the sound control region 11. The reflected sound waves are generated by the loudspeakers directing sound waves at reflective or reverberant surfaces, such as walls in the room. The reflected sound may have undergone one, two or multiple reflections before propagating into the sound control region. The purpose of the reflected sound waves is to exploit the room's natural reverberation to create additional acoustic impressions or acoustic sound directions from what appear to be virtual sound sources thereby enabling a full spatial sound field reproduction without requiring a large array of speakers surrounding the listener from all directions.

The surround sound system could be implemented with a 2-D spatial sound field reproduction or a more complex 3-D sound field reproduction. The example embodiments of the surround sound system to be described focus on the 2-D implementation with the sound control region located in a substantially horizontal plane in space within the room environment and with the array of loudspeakers located in substantially the same plane in space, but the design modifications required for providing a 3-D implementation will also be discussed, which may involve a spherical sound control region and employing loudspeakers in locations on the ceiling and floors.

More specifically, in this specification unless the context suggests otherwise, 2-D spatial sound field reproduction is intended to relate to reproduction of the spatial sound in a 2-D sound control region, typically circular, which may have a desired predefined height or thickness vertically, and in which the surround sound system may typically comprises a circular array of loudspeakers surrounding the 2-D sound control region and which are arranged to propagate sound waves horizontally into the sound control region. The thickness of the 2-D sound control region may be determined by the loudspeaker vertical dimensions, or whether the loudspeakers are vertical line arrays or electrostatic loudspeakers that are capable of propogating sound waves horizontally toward the sound control region over a vertical range corresponding to the thickness of the 2-D sound control region. In this specification, unless the context suggests otherwise, 3-D spatial sound field reproduction is intended to relate to the spatial sound in a 3-D sound control region, typically a spherical region, and in which the surround sound system may comprise a spherical array of loudspeakers surrounding the 3-D sound control region and which are oriented or configured to propagate sound waves into the 3-D sound control region at any desired elevation angle, whether horizontal, vertical or any other angle.

In this embodiment, the control unit 14 has two modes of operation, a configuration mode and a playback mode. The configuration mode must be operated at least once before the playback mode can operate effectively. During set-up of the surround sound system, the configuration mode is initiated once all the loudspeakers are positioned about the sound control region in the room. The configuration mode customises the performance of the system to the loudspeaker layout and reverberance properties of the room so as to configures the responses of the loudspeakers to exploit the natural reverabaration in the room, and to use both the direct sound path and available reverberant reflections to reproduce the spatial sound field represented by an input spatial audio signal when in playback mode. Once configured, the system can be switched into playback mode for sound field reproduction. The system typically remains in playback mode until the loudspeaker positions are altered or the room reverberation properties changed in any way, in which case the configuration mode is typically re-initiated to re-calibrate the system for the new set-up or environment.

FIG. 1 shows the system in the playback mode. The system receives input spatial audio signals 16 representing the spatial sound field for reproduction and processes that input signal to generate and deliver 2M+1 speaker input signals 13 over wiring or wirelessly to each of a number L of "smart" configurable loudspeaker units 12 represented by the pentagonal boxes, which then play out directional sound for reconstructing the spatial sound filed in the sound control region. The input spatial audio signal may be in any format, including by way of example ambisonics or Dolby surround or any other spatial format. The number M represents the order of the directional responses achievable by each loudspeaker 12 and this may be altered to suit system requirements as desired.

By way of example only, the system is capable of reproducing a full ambisonics sound field, but also emulating or reproducing other spatial sound signal formats, including Dolby surround and others. The surround sound system may be a stand-alone system that receives the input spatial audio signals 16 from another audio playback device, Personal Computer, or home theatre or entertainment system, or may be integrated as a component or functionality of such systems or devices.

The various components and mode operations of the surround sound system will now be individually described in more detail.

2. Control Unit

Figure 2:
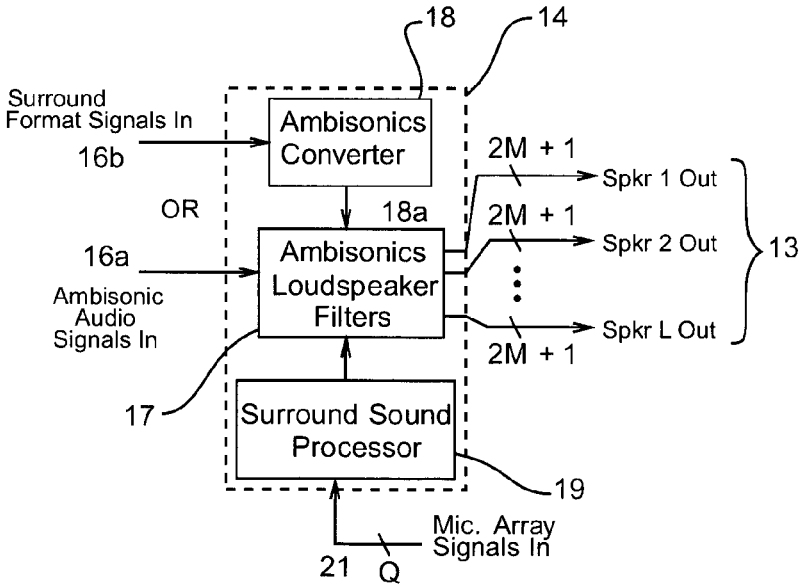
FIG. 2 is a schematic diagram of a central control unit of the surround sound system in accordance with an embodiment of the invention.

Referring to FIG. 2, the control unit 14 will be described in more detail. During playback mode, the control unit 14 receives the input spatial audio signals 16 and comprises pre-configured filters 17 that are arranged to filter the input signals 16 into speaker input signals 13 for driving each of the loudspeakers 12 to generate sound waves with a desired directional response for recreating the spatial sound field in the sound control region. In this embodiment, the control unit is configured to work in an ambisonics sound format and comprises ambisonics loudspeaker filters.

In this embodiment, the input spatial audio signals 16 containing the spatial audio information is delivered to the control unit 14 as several input sound channels. By way of example, it may be composed of (i) ambisonically-encoded sound information, (ii) spatial information on the phantom source location(s) from which each sound channel will be played, or (iii) one of a variety of surround-formatted signals. By way of example only, the surround multi-format signals could include: stereo, Dolby Digital™, DTS Digital Surround™, THX Surround EX, DTS-ES and others.

In this embodiment, the control unit 14 is configured to receive either an ambisonically-encoded input signals 16*a* or one or more other formats of surround-encoded input signals 16*b*. The ambisoncially-encoded 16*a* input signals are filtered directly by the filters 17, while other format signals 16*b* are first processed by an ambisonics converter 18 and converted into an ambisonics format for subsequent processing by the filters 17. It will be appreciated that other embodiments of the control unit need not necessarily provide this multi-format input capability and may provide only one format of input signal if desired. In operation, the central control unit 14 processes and delivers each of the excitation input signals to the directional response components of each smart loudspeaker unit 12 for playback of and reproduction of the spatial sound field.

As previously discussed, the pre-configured filters 17 are configured or customised for the arrangement of loudspeakers 12 and room reverberation characteristics in the configuration mode. This is achieved by measuring acoustic transfer functions for each of the loudspeaker directional responses in the sound control region, which will be explained in further detail later. The signal processing performed by the central control unit 14 and the storage of acoustic transfer functions in the ambisonically-encoded spatial sound format will be described in further detail below.

Figure 3:
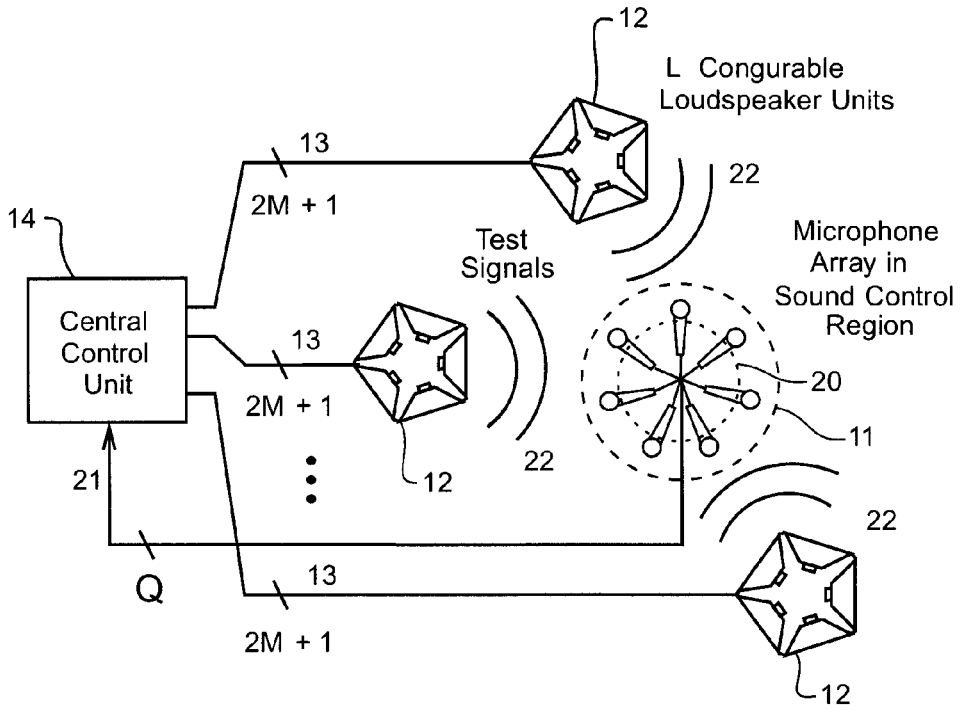
FIG. 3 is a schematic diagram of the surround sound system in accordance with an embodiment of the invention, in a configuration mode using a microphone array sound field recording system.

As shown, the control unit 14 also comprises a configuration module in the form of a surround sound processor 19 that is configured to measure the acoustic transfer functions to the sound control region at a number of frequencies in the configuration mode of the system and then configure the filters 17 based on those measured acoustic transfer functions. As shown in FIG. 3, the acoustic transfer functions of each loudspeaker channel are best obtained using a microphone array 20 located in the sound control region. The configuration mode involves generation of test signals and playing through each channel of each smart loudspeaker and converting the resulting microphone array signals into an ambisonic representation of the acoustic transfer functions. As mentioned above, the acoustic transfer functions are then used to configure each of the ambisonic loudspeaker filters 17.

The ambisonics input signal 16, surround sound processor 19, ambisonics converter 18, and ambisoncics loudspeaker filters 17 will each be described in further detail below.

2.1 Ambisonics Input Signal

The central control unit 14 requires information regarding the spatial placement of the sound. Ambisonics pertains to the representation of a spatial sound field. Ambisonics has both 2-D and 3-D versions. The B-format recording is one of the earliest realizations of ambisonics, which records the sound pressure and 3 components of velocity at a point in space, then reproduces the sound field using an array of loudspeakers [9]. For 2-D reproduction, only two components of velocity are measured. The ambisonics B-format thus consists of 3 signals in 2-D (pressure plus two components of velocity) and 4 signals in 3-D (pressure plus three velocity components). This sound field is reproduced accurately over a large area only at low frequencies. Since the area of accurate reproduction reduces with frequency, this spatial sound reproduction is inadequate over much of the audible frequency range. For a disc-shaped (2-D) or spherical control region (3-D) the radius for accurate reproduction is only $R=s_v/2\pi f=55$ mm at 1 kHz where $s_v$ is the speed of sound.

For sound field reconstruction over a larger area, one may use Higher Order Ambisonics (HOA), which is adopted in the surround sound system of the invention. In HOA, the sound field at each point $(r,\phi)$ over a circular region at frequency f can be written in terms of the ambisonics expansion about the origin:

$$P(r,\phi \mid f)=\sum_{n=-N}^{N}\beta_n(f)J_n(kr)e^{in\phi} \tag{1}$$

where $J_n(\cdot)$ is the Bessel function of order n, $\beta_n(f)$ is the 2-D ambisonics coefficient at frequency f, $k=2\pi f/s_v$ is the wave number and N is the order of the ambisonics field related to the radius of the circular region by $R=Ns_v/2\pi f$ (For a B-format recording, N=1). We record the sound field by measuring the coefficients over a finite range n=−N, . . . , N producing the Nth order ambisonics signal set. One requires at least 2N+1 drivers to reproduce the Nth order HOA in 2-D.

The sound field at each point $(r,\theta,\phi)$ over a 3D spherical region can be written in terms of the ambisonics expansion about the origin:

$$P(r,\theta,\phi \mid f)=\sum_{q=0}^{N}\sum_{p=-q}^{q}\beta_q^p(f)J_q(kr)Y_q^p(\theta,\phi) \tag{2}$$

where $j_q(\cdot)$ is the spherical Bessel function of order n, $Y_q^p(\cdot)$ is the spherical harmonic function and $\beta_q^p(f)$ is the 3-D ambisonics coefficient. One requires at least $(N+1)^2$ drivers to reproduce the Nth order HOA in 3-D.

There are equivalent ambisonic representations to the complex angular functions $e^{in\phi}$ (2-D) or $Y_q^p(\theta,\phi)$ (3-D) which are real. Either the real or the complex functions could be used in the surround sound system of the invention. Real representations have implementation advantages but are easy to obtain from the complex functions [11].

Alternatively to ambisonics, the input audio signal spatial information delivered to the central control unit 14 could consist of a number of sound channels, each for several phantom source, each channel additionally having the following specified:

(i) a polar orientation angle $\phi$ for a 2-D system, (ii) an orientation angle pair consisting of an azimuth angle $\phi$ and elevation angle $\theta$ for a 3-D system, and (iii) an optional phantom source range r.

There are standard equations for converting such spatial sound information into an ambisonics format. Such equations shall be used to reconstruct the sound fields up to Nth order ambisonics for the loudspeaker location of a Dolby Surround, DTS or other commercial surround system.

2.2 Surround Sound Processor and Configuration Mode

As mentioned above, the surround sound processor 19 of the control unit 14 is operable to receive and process acoustic transfer function data 21 representing the acoustic transfer functions measured during the configuration mode by the microphone array 20. At a general level, to determine the acoustic transfer functions in the room, a number of test signals are played out of each smart loudspeaker, and the response recorded by the central control unit 14 using a microphone array.

For determining each of the acoustic transfer functions, a test signal 22 is generated and directed to each channel of each smart loudspeaker. Each channel of the loudspeaker generates a different directional response. The impulse response to each microphone in the microphone array is then measured. The test signal used may be a pulse signal, but more practically a wideband chirp or Maximum Length Sequence signal may be used. The filters 17 can then be configured in the frequency domain, using just the positive frequencies, so it is possible to measure the complex ambisonics coefficients of the acoustic transfer functions. Ambisonics is an efficient means of storing the acoustic transfer function for each channel of each smart loudspeaker at a number of frequencies. This control unit 14 stores the acoustic transfer function data in the form of the ambisonic loudspeaker filters 17 after signal processing to be detailed below. In brief, the surround sound processor 19 takes the measured acoustic transfer function data, applies FFT and mode weighting matrices, then does a matrix inversion before it stores the data into the ambisonic loudspeaker filters 17.

More particularly, the surround sound processor 19 is configured to receive and convert the raw microphone array acoustic transfer function data at each frequency into the (ambisonic) modal decomposition of the acoustic transfer functions in equations (3) and (5) below, in 2-D by using a FFT matrix 23 followed by a phase mode weighting matrix 24 dependent on the array radius and type of housing [4] or in 3-D by using a spherical harmonic transform matrix followed by a 3-D mode weighting matrix [14]. The surround sound processor is then arranged to configure the ambisonic loudspeaker filters 17 based on the measured and processed acoustic transfer function coefficients, and which is explained in further detail below.

Figure 4:
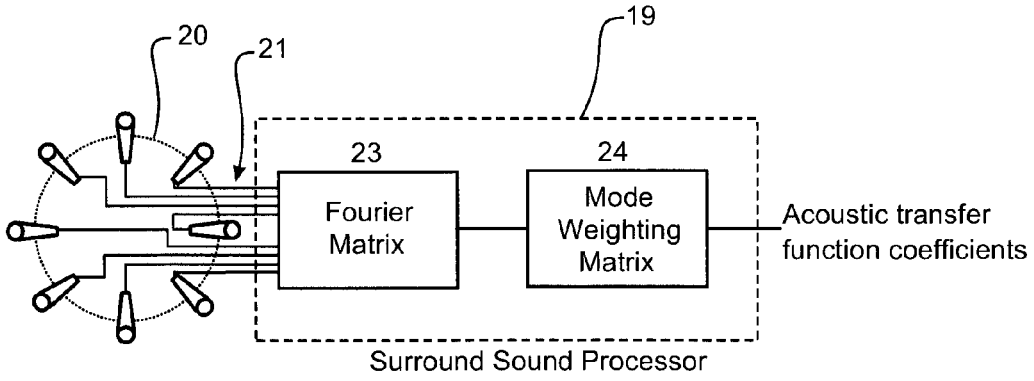
FIG. 4 is a schematic diagram of a microphone array sound field recording system for measuring acoustic transfer function data for the surround sound system in its configuration mode in accordance with an embodiment of the invention.

The use of a microphone array for sound field recording is known by those skilled in the art. Any suitable microphone array design may be used that is capable of measuring the acoustic transfer functions from each loudspeaker to any point in the sound control region [1-4]. A 2-D implementation may use a uniform circular array geometry 20 as shown in FIG. 4. A 3-D implementation may use a spherical array. At least Q=2N+1 elements for 2-D and $Q=(N+1)^2$ elements in 3-D are required where N=kr, arranged at radius comparable to the desired size of the sound control region 11. In a 2-D embodiment, there may be advantage in using directional microphones that are pointed horizontally along the plane of the control region, so that reverberation due to lateral reflection could be reduced.

As mentioned, the computation and configuration of the ambisonic loudspeaker filters 17 for sound reproduction is implemented within the Surround Sound Processor 19. This process for the 2-D implementation is first explained, followed by the 3-D implementation. It is desired to reproduce a number of ambisonic sound fields using a set of L smart loudspeakers.

For the 2-D implementation, consider a sound field with expansion about an origin given by ambisonics expansion in equation (1). The ambisonics coefficients of the desired sound field are $\beta_n(f)$ expressed in the frequency domain. The control unit 14 requires a set of acoustic transfer functions for each loudspeaker. The acoustic transfer functions are efficiently stored as a set of ambisonically-encoded modal coefficients $\alpha_n(l,m|f)$ defined in terms of the sound field created by the mth directional response of each loudspeaker l:

$$H_{ml}(r,\phi;f)=\sum_{n=-N}^{N}\alpha_n(l,m\mid f)J_n(kr)e^{in\phi}. \tag{3}$$

The coefficients $\alpha_n(l,m|f)$ are measured in the configuration mode of operation at the intended listening position with aid of the microphone array 20. A total of (2M+1)L sets of 2N+1 coefficients are produced.

As mentioned, the surround sound processor 19 of the central control unit 14 determines the loudspeaker filters to be applied to the spatial audio signals based on the measured acoustic transfer functions. In a preferred embodiment, the loudspeaker filters are designed to reconstruct the nth spatial sound mode $J_n(kr)e^{in\Phi}$. We determine the loudspeaker filters $G_n(l,m|f)$ to recreate each nth spatial mode as follows: The sound pressure resulting in the room from the loudspeaker weights for creating the nth mode $\{G_n(l,m|f)$: m=1, . . . , 2M+1, l=1 . . . L$\}$ is:

$$J_n(kr)e^{in\phi}=\sum_{l=1}^{L}\sum_{m=1}^{2M+1}G_n(l,m\mid f)H_{bm}(r,\theta,\phi\mid f).$$

Substituting in equation (3), we determine an equation for determining each loudspeaker filter:

$$J_n(kr)e^{in\phi}=\sum_{n'=-N}^{N}\left[\sum_{l=1}^{L}\sum_{m=1}^{2M+1}G_n(l,m\mid f)\alpha_{n'}(l,m\mid f)\right]J_{n'}(kr)e^{in'\phi},$$

which by orthogonality of complex exponentials is satisfied if the following set of equations are satisfied:

$$\sum_{l=1}^{L}\sum_{m=1}^{2M+1}\alpha_{n'}(l,m\mid f)G_n(l,m\mid f)=\begin{cases}1, & n'=n\\ 0, & \text{otherwise,}\end{cases}$$

for n'=−N, . . . , N. This set of 2N+1 equations can be written in matrix-vector form:

$$A(f)g_n(f)=e_n,$$

where $[A(f)]_{n+N+1,(l-1)(2M+1)+m}=\alpha_n(l,m|f)$, $[g_n(f)]_{(l-1)(2M+1)}=G_n(l,m|f)$ and $e_n$ is an 2N+1-long vector where element n+N+1 is one and all other elements are zero. Here $[M]_{ij}$ denotes the element in the ith row an jth column in matrix M whilst $[v]_i$ denotes the ith element of vector v. Vector $g_n(f)$ contains the L(2M+1) loudspeaker filter weights at frequency f to apply to the configurable loudspeaker channels to create the spatial mode corresponding to the nth ambisonic coefficient. As a result, a matrix G(f) $[g_{-N}(f), g_{-N+1}(f), \ldots, g_N(f)]$, whose 2N+1 columns are the loudspeaker weight vectors for creating the ambisonic spatial sounds at frequency f up to order N, can be determined by taking the regularized pseudo-inverse of A(f) through the Tikhonov-regularized least squares. The matrix A(f) is long, since a robust solution would entail using more drivers, L(2M+1), than the 2N+1 reproducible ambisonic channels. As a result the solution is:

$$G(f)=A(f)^H[A(f)A(f)^H+\lambda I]^{-1} \tag{4}$$

where λ is a single regularization parameter. The parameter λ may either be tuneable or have a fixed value selected in the device.

The required filters to create the 2-D ambisonics spatial sound field are shown to be related to the 2M+1 acoustic transfer function coefficients for each of the L configurable loudspeakers. There are L(2M+1) acoustic transfer functions for each mode. The Surround Sound Processor 19 hence determines the ambisonics loudspeaker filters directly from the measured acoustic transfer function coefficients.

The approach presented here represents a frequency-domain approach, where the output is a collection of loudspeaker weights at a number of frequencies. This approach culminates in a time-domain approach, where the output is a collection of time-domain filters. The solutions may be calculated at each frequency, and the inverse FFT used to produce the required digital filter for filtering the nth ambisonics signal for the mth mode of the lth loudspeaker.

In a 3-D implementation, the desired spatial sound field can be written as equation (2) where $\beta_q^p(f)$ is now an ambisonics coefficient of the desired sound field. The acoustic transfer functions are efficiently stored as a set of ambisonically-encoded modal coefficients $\alpha_q^p(l,m|f)$ defined in terms of the sound field created by the mth directional response of each loudspeaker l:

$$H_{ml}(r,\theta,\phi;f)=\sum_{q=0}^{N}\sum_{p=-q}^{q}\alpha_q^p(l,m\mid f)j_q(kr)Y_q^p(\theta,\phi) \tag{5}$$

In a preferred embodiment, the loudspeaker filters are designed to reconstruct the (p,q)th ambisonic spatial sound mode $j_q(kr)Y_q^p(\phi,\theta)$. We determine the loudspeaker weights $G_q^p(l,m|f)$ to recreate each spatial mode (p,q) at frequency f as follows. The sound pressure resulting in the room from loudspeaker weights is:

$$j_q(kr)Y_q^p(\theta,\phi)=\sum_{l=1}^{L}\sum_{m=1}^{(M+1)^2}G_q^p(l,m\mid f)H_{lm}(r,\theta,\phi\mid f).$$

Substituting in equation (5), we obtain an equations for determining the (p,q)th loudspeaker filter $$j_q(kr)Y_q^p(\theta,\phi)=\sum_{q'=0}^{N}\sum_{p=-q'}^{q'}\left[\sum_{l=1}^{L}\sum_{m=1}^{(M+1)^2}G_q^p(l,m\mid f)\alpha_{q'}^{p'}(l,m\mid f)\right]j_{q'}Y_{q'}^{p'}(\theta,\phi),$$

which by orthogonality of spherical harmonics is satisfied if the following set of equations are true:

$$\sum_{l=1}^{L}\sum_{m=1}^{(M+1)^2}G_q^p(l,m\mid f)\alpha_{q'}^{p'}(l,m\mid f)=\begin{cases}1, & p'=p,\ q'=q\\ 0, & \text{otherwise,}\end{cases}$$

for $\{(p',q'): q'=0,1,\ldots,N,\ p'=-q',\ldots,q'\}$. The set of $(N+1)^2$ equations for each (p,q) can be written in matrix-vector form as:

$$A(f)g_q^p(f)=e_q^p,$$

where $[A(f)]_{p^2+q+p+1,(l-1)(M+1)^2+m}=\alpha_q^p(l,m|f)$, $[g_q^p(f)]_{(l-1)(M+1)^2}=G_q^p(l,m|f)$ and $e_q^p$ is an $(N+1)^2$-long vector where element $p^2+q+p+1$ is one and the other elements are zero. As a result, a matrix $G(f)=[g_0^0(f), g_1^{-1}(f),\ldots,g_N^N(f)]$ whose $(N+1)^2$ columns are the loudspeaker weight vectors for creating the ambisonic spatial sounds at each frequency up to order N can be determined by taking the regularized pseudo-inverse of A(f) through the Tikhonov-regularized least squares. The matrix A(f) is again long, since a robust solution would entail using more drivers $L(M+1)^2$ than the $(N+1)^2$ reproducible spatial modes. The solution is again given by equation (4).

The required filters to create the (p,q)th 3-D ambisonics spatial sound field are again related to the $(M+1)^2$ acoustic transfer function coefficients for each of the L smart loudspeakers corresponding to the same mode (p,q). There are $L(M+1)^2$ acoustic transfer functions for each mode.

2.3 Ambisonics Loudspeaker Filters

As mentioned above, the ambisonics loudspeaker filters 17 of the control unit 14 are configured for the room during the configuration mode prior to switching to the playback mode of the surround sound system. The filters may be digital filters, such as Finite Impulse Response (FIR) filters for example. The ambisonics loudspeaker filters 17 apply the appropriate filtering to construct the appropriate spatial sound field from each ambisonics input signal channel in playback mode shown in FIG. 1.

Figure 5:
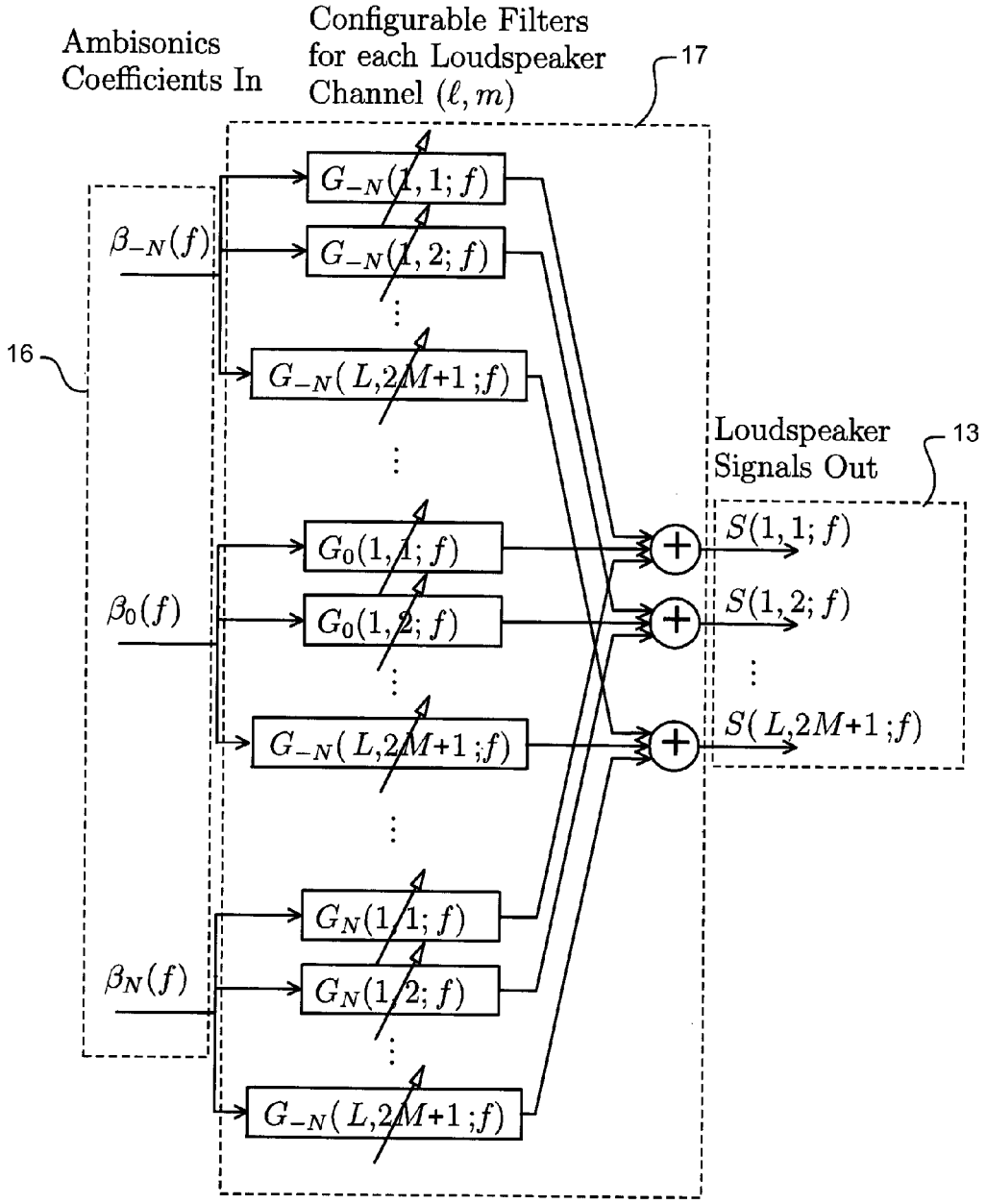
FIG. 5 is a schematic diagram of the configurable loudspeaker filters in the central control unit in accordance with an embodiment of the invention.

In the 2-D embodiment of the system, the sound field represented by coefficients $\{\beta_n(f): n=-N\ldots N\}$ is reproduced using several smart loudspeakers 12, each of which is capable of generating 2M+1 polar responses, M being the order of the directional response. In this embodiment, each configurable loudspeaker may contain from M=1 to 4, although higher order directional responses, e.g. up to $20^{th}$ order or higher still may be required for higher operating frequencies. As shown in FIG. 5, performing this ambisonics reproduction requires a set of loudspeaker filters for each ambisonics coefficient $\beta_n(f)$. For example, the Ambisonics Loudspeaker Filters 17 process ambisonic signals of the spatial sound field by the set of configurable filters $\{G_n(l,m;f): n=-N\ldots N,\ l=1\ldots L,\ m=1\ldots 2M+1\}$ to yield the output signals S(l,m;f) for each channel m of each configurable loudspeaker l. The number of smart loudspeakers in FIG. 5 is L, numbers of configurable channels on each loudspeaker is 2M+1 and numbers of ambisonic coefficients is 2N+1 (where N is the order of the ambisonics reproduction), making a total of L(2N+1)(2M+1) loudspeaker filters required in the Ambisonics Loudspeaker Filters box 17 of the Central Control Unit 14. As previously discussed, the filters are set during the configuration mode by the Surround Sound Processor 19. In a 3-D embodiment of the system, the sound field is represented by coefficient $\{\beta_n^m(f): m=-n\ldots n,\ n=0\ldots N\}$. This is completely analogous to the 2-D case but for Mth order, each smart loudspeaker must be capable to generate $(M+1)^2$ 3-D directional responses, and requires a total of $L(N+1)^2(M+1)^2$ loudspeaker filters required for the Ambisonics Loudspeaker Filters box 17.

By way of example only, to reconstruct sounds at 1 kHz (2 kHz) in a disc of diameter 60 cm (30 cm) sound control region, at least an ambisonics order of N=6 is required. The numbers of temporal loudspeaker filters for any conceivable $6^{th}$ order 2-D ambisonics reproduction system are: $156\leq L(2N+1)(2M+1)\leq 936$ for L=4 to 8 configurable loudspeakers, and where M=1 to 4 in this embodiment, although it will be appreciated that the limits will alter if higher order loudspeakers are employed. More loudspeaker filters are required if the desire is to increase the size of the reproduction region beyond what is mentioned here.

2.4 Ambisonics Converter

In the embodiment shown in FIGS. 1 and 2, the central control unit 14 is capable of processing a multi-format surround signal 16*b* for reproduction with the surround sound system. The central control unit 14 comprises an ambisonics converter module 18 that is configured to process a multi-format surround signal into an ambisonics signal format for processing by the filters 17 for playback over the loudspeakers 12, as is the case with the direct ambisonic input signal 16*a*.

In one embodiment, the Ambisonics Converter 18 is used for converting Dolby 5.1 surround signals 16*b* into ambisonics coefficients 18*a* to generate phantom sources positioned in the standard five loudspeaker ITU geometry used in Dolby Digital and DTS Digital Surround. In an alternative embodiment, the Ambisonics Converter 18 could also support stereo sound or the seven loudspeaker layouts of THX Surround EX and DTS-ES where the loudspeaker locations are different. The converter 18 makes the surround sound system downward compatibility with currently-available technologies.

By way of example, we show one possible method of converting these surround sound formats into an ambisonic format given the desired loudspeaker locations. For an acoustic monopole in 3-D, the sound pressure at point $x=(r,\theta,\phi)$ truncated to Nth order ambisonics is:

$$\frac{\exp\{-ik\|x-y\|\}}{4\pi\|x-y\|} = ik\sum_{q=0}^{N}\sum_{p=-q}^{q} h_q^{(2)}(kr_s)[Y_q^p(\theta_s,\phi_s)]*j_q(kr)Y_q^p(\theta,\phi)$$

where $y=(r_s,\theta_s,\phi_s)$ is the position of the monopole source and S(f) is the transmitted sound signal. For an acoustic monopole in 2-D, the sound pressure at point $x=(r,\phi)$ for a monopole source located at $y=(r_s,\phi_s)$ the Nth order ambisonic reconstruction of the sound pressure is:

$$H_0^{(2)}(k\|x-y\|) = \sum_{n=-N}^{N} H_n^{(2)}(kr_s)e^{-in\phi_s}J_n(kr)e^{in\phi},$$

where $H_n^{(2)}(\cdot)$ is the Hankel function of the second kind of order n. The ambisonics coefficients of an acoustic monopole are hence $\beta_q^p(f)=ikh_q^{(2)}(kr_s)[Y_q^p(\theta_s,\phi_s)]^*$(3-D embodiment) and $\beta_n(f)=H_n^{(2)}(kr_s)e^{-in\phi_s}$ (2-D embodiment) multiplied by the spectrum of the audio signal for playback. Whatever the surround sound format, the ambisonics signals can be determined from a list of the format's standard loudspeaker positions, the audio playback signals and depending upon the format, perhaps the required loudspeaker directivity patterns.

3. Configurable Loudspeaker Design and Room Arrangement

3.1 Design of Loudspeaker

Each loudspeaker 12 is capable of creating a number of configurable directional responses over a number of frequencies, and may preferably have the capability of steerability of the beam pattern in 360° in the 2-D implementation. Each smart loudspeaker 12 is driven by several speaker input signals 13, each signal line drives a separate loudspeaker directional response. The loudspeakers 12 may provide onboard amplification to each driving signal, or alternatively the amplification may be provided in the central control unit or other amplifier module(s), whether integrated with the central control unit or each loudspeaker or provided as a separate component.

Figure 6A:
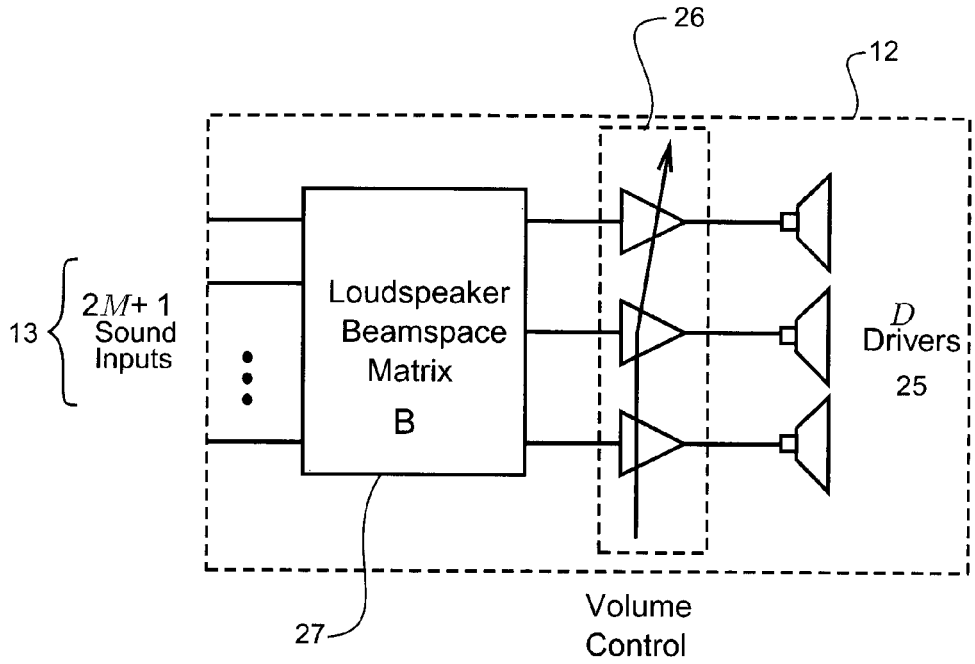
FIG. 6A is a schematic diagram of a steerable loudspeaker in accordance with an embodiment of the invention.
Figure 6B:
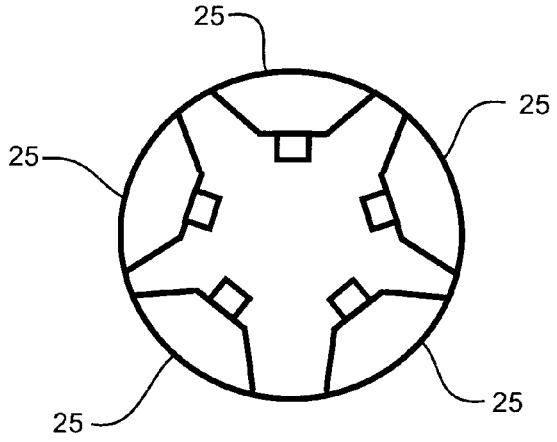
FIG. 6B is a schematic diagram of the driver array configuration for a steerable loudspeaker in accordance with an embodiment of the invention.

FIGS. 6A and 6B shows a possible design of a loudspeaker 12 in an embodiment of the surround sound system. FIG. 6A shows a block diagram of a loudspeaker processing 2M+1 speaker input signals 13 to feed D drivers 25 through a master volume control 26 and FIG. 6B shows a possible physical construction of a smart loudspeaker with an outwardly oriented symmetrical circular arrangement. While preferred, the loudspeaker arrangements need not necessarily be circular, spherical or cylindrical. An alternative geometry could in theory be used, as long as it performs well. A frequency domain embodiment of the unit is shown by virtue of using a beamspace matrix 27 which processes and mixes the speaker input signals 13 to generate the overall desired directional response from the individual directional response channels.

As shown in FIGS. 6A and 6B, each smart loudspeaker 12 has a directivity response determined by beamformer drivers (loudspeaker elements) and configured by the speaker input signals 13. In this embodiment, the beamformer consists of a loudspeaker beamspace matrix 27, which is embodied as either:

1. A frequency domain implementation where a set of F beamspace matrices operates on the input signals 13, over F frequency subbands. Each beamspace matrix creates 2M+1 beam patterns intended for D drivers over the frequency subband.
2. A time domain implementation where a matrix of time domain filters creates 2M+1×F beam patterns over the entire frequency band for the D drivers.

As mentioned, a series of D amplifiers 26 may be provided for magnifying the signals to volume levels appropriate for playback. The amplified signals are each delivered to a loudspeaker (driver) co-located in common housing. In this embodiment, the housing is compact and the driver 25 geometry in each loudspeaker 12 is chosen to generate directional patterns over a range of directions. A circular driver geometry is shown in FIG. 6B for 2-D reproduction but for 3-D field reproduction a spherical or cylindrical geometry would be better suited.

The number of drivers and input channels 13 for the loudspeakers 12 may vary depending on the surround sound system playback requirements. For the surround sound system to exploit room reflections, it is generally required for each configurable loudspeaker to be able to create at least a $M=1^{st}$ order directivity pattern, and preferably up to $4^{th}$ order.

The loudspeakers 12 create directional responses up to Mth order using a small number D of drivers ($D\geq 2M+1$ in 2-D and $D\geq(M+1)^2$ in 3-D). The 2-D implementation of the smart loudspeaker might include (i) constructing the 2M+1 phase mode directional responses $\{e^{im\phi}: m=-M, \ldots, M\}$, (ii) constructing an omni-directional response, as well as each of the directional responses $\cos(m\phi)$ and $\sin(m\phi)$ for m=1, 2, . . . , M. For a 3-D implementation, the smart loudspeaker could construct an omni-directional response, as well as the real parts $\{\mathrm{Re}[Y_n^m(\theta,\phi)]: m=0 \ldots n, n=1 \ldots M\}$ and imaginary parts $\{\mathrm{Im}[Y_n^m(\theta,\phi)]: m=1 \ldots n, n=1 \ldots M\}$ of the spherical harmonic functions. The Loudspeaker Beamspace Matrix 27 and the geometric arrangement of the drivers within the housing of the configurable loudspeaker unit 12 are selected to create such directional responses over a wide range of frequencies. These design aspects are further described below.

The physical layout of the drivers within the loudspeaker 12 will now be described. The far-field directivity pattern $D_l(\phi|f)$ of loudspeaker l at frequency f can be written as the phase mode expansion:

$$D_l(\phi \mid f) = \sum_{m=-M}^{M} \alpha_m(l \mid f) e^{im\phi}$$

where $\alpha_n(l|f)$ are the weighting coefficients for the nth order phase mode. Each directional loudspeaker is realized by arranging a number D of monopoles drivers into a uniform circular array of radius r. To ensure loudspeaker responses up to Nth order are obtainable, one designs each monopole array choosing r and D as follows:

Choose r=M/k to excite a necessary number of spatial modes, up to order M [16].

Choose D≥2M+1 to ensure adequate that number of degrees of freedom are available to create the loudspeaker responses.

This scheme ensures monopoles are spaced λ/2 or less apart to avoid spatial aliasing at frequency f, corresponding to the lowest frequency in the operating frequency of the surround sound system. The array design may be constructed by housing the D drivers inside a cylindrical loudspeaker box. The driver weights are then chosen according to regularized least squares to suit the sound field reproduction problem. Typically, the audio operating frequency range of the surround sound system is preferably in the range of 60 Hz-12 kHz, more preferably 30 Hz-20 kHz.

As discussed, the beamformer module of each loudspeaker 12 may be in the form of a beamspace matrix. Each loudspeaker is designed to generate the 2M+1 directional responses (2-D implementation) or $(M+1)^2$ responses (3-D implementation) up to order M, using D drivers. By way of example, the following illustrates the design for acoustic monopole drivers in free-space in one embodiment of the loudspeaker design. In alternative 2-D embodiments, the drivers are mounted onto the equator of a hard cylinder or sphere. Suppose each monopole d of a directional loudspeaker at frequency f is excited by loudspeaker weight $b_{md}(f)$ where m=−, . . . , M and d=1, 2, . . . , D. To choose the loudspeaker weights to construct the nth phase mode in the far-field, it is necessary to match the directivity pattern $e^{im\phi}$ across the continuous angular range $\phi \epsilon [0,2\pi]$:

$$\sum_{d=1}^{D} b_{md}(f) e^{-ikr\vartheta_d \cdot \varphi} = e^{im\phi}$$

where $\theta_d=[\cos\theta_d, \sin\theta_d]^T$, $\theta_m$ is the orientation angle of monopole m and $\phi=[\cos\phi, \sin\phi]^T$. If the loudspeaker vector for the D element array to construct the mth order phase mode is $b_m=[b_{m1}, b_{m2}, \ldots, b_{mD}]^T$ then $b_m$ can be designed by matching the directivity pattern at Q angles $\{\phi_1, \phi_2, \ldots, \phi_Q\}$:

$$Eb_m=p_m$$

where $[p_n]_q=e^{ip\phi_q}$ is the vector of phase mode p, $[E]_{qm}=e^{-ik\theta_m \cdot \phi}$ is the matrix of beam steering vectors to each direction $\theta_m=[\cos\theta_m, \sin\theta_m]^T$, $\phi_q=[\cos\phi_q, \sin\phi_q]^T$ and we choose $\phi_q=2\pi(q-1)/Q$. Define the matrix of phase mode weights $B=[b_{-N}, b_{-N+1}, \ldots b_N]^T$, for which we obtain through the least squares solution:

$$B=E^+P$$

where $P=[p_{-M}, \ldots, p_m]$ and $E^+=(E^HE)^{-1}E^H$ is the pseudo-inverse of E. The matrix B for each loudspeaker transforms the 2M+1 phase mode weights into D driver weights.

The preferred directional responses for the channels of the loudspeakers are an omnidirectional pattern, cos mθ patterns and sin mθ patterns, (for m up to order M) are preferred. However, also acceptable are the phase mode responses $e^{im\theta}$ (for m equalling −M up to M).

3.2 Physical Arrangement of Loudspeakers in Room

Figure 7A:
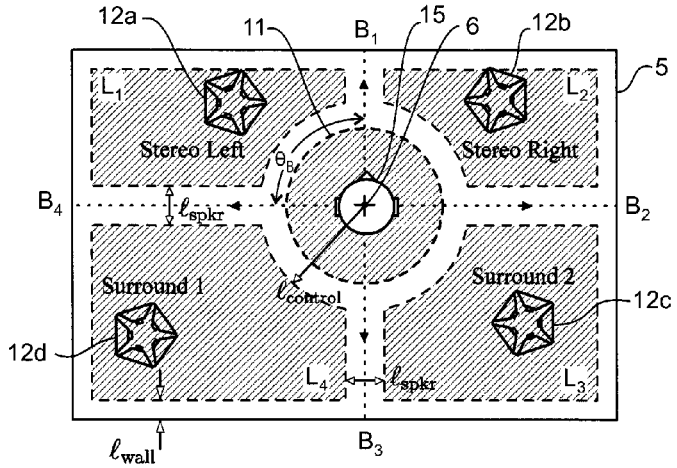
FIG. 7A is a schematic diagram of another possible geometric arrangement of four loudspeakers of the surround sound system in the form of a corner-like configuration about a sound control region in a room in accordance with an embodiment of the invention.
Figure 7B:
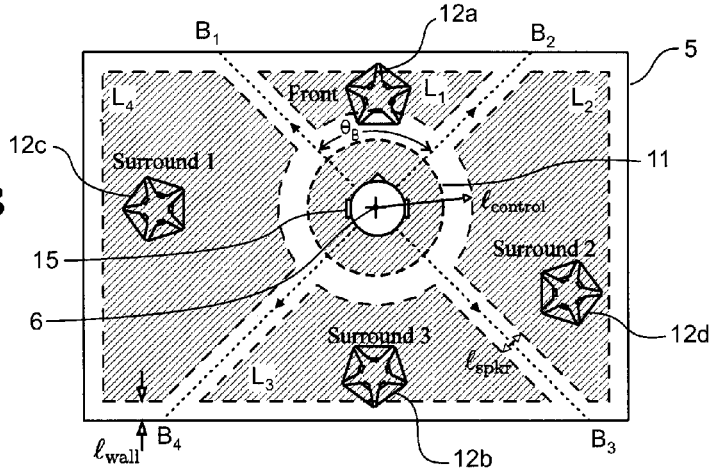
FIG. 7B is a schematic diagram of a possible geometric arrangement of four loudspeakers of the surround sound system in the form of a diamond-like configuration about a sound control region in a room in accordance with an embodiment of the invention.
Figure 7C:
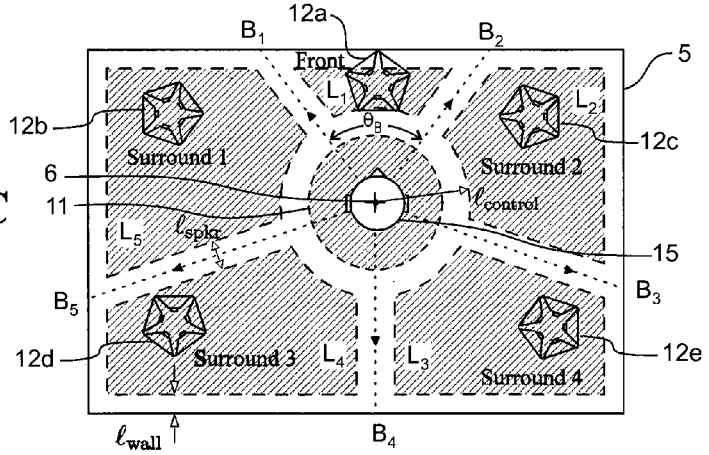
FIG. 7C is a schematic diagram of a possible geometric arrangement of five loudspeakers of the surround sound system in the form of a Dolby-surround-like configuration about a sound control region in a room in accordance with an embodiment of the invention.

FIGS. 7A-7C depicts various possible example plan view configurations of loudspeakers 12 in an enclosed rectangular room 5 in terms of the dimension distance of a loudspeaker from a wall $l_{wall}$, distance of loudspeakers from each other $l_{spkr}$ and distance of a loudspeaker from center of the sound control region $l_{control}$. Shown are example four and five loudspeaker geometries where the loudspeakers are adequately spaced and roughly surrounding the sound control region. The geometric arrangement may be varied depending on the shape and configuration of the room, the number of loudspeakers 12 provided in the surround sound system, and the position and orientation of the sound control region 11. Generally, the geometric arrangement of the smart loudspeaker array in the room may vary provided that is appropriate for creating the spatial sound effects in a robust manner. Typically, the physical layout consists of several loudspeakers 12 positioned at several positions in the room around the sound control region 11. To create the sensation of spatial sounds robustly, one requires the smart loudspeakers 12 to be positioned to surround the sound control region.

Typically, the surround sound system will function with L=4 to 8 configurable loudspeakers 12, although additional loudspeakers may increase performance of the system in certain environments.

In preferred embodiments, the room 5 is equally divided or segmented radially about the origin 6 at the center of the sound control region into loudspeaker location regions $L_1$, $L_2$, . . . $L_L$, where L=the number of loudspeakers in the surround sound system. A loudspeaker is located at any location within its respective loudspeaker location region, such that there is one loudspeaker per loudspeaker location region. Each loudspeaker location region is defined to extend between a pair of dotted radii boundary lines $B_1$, $B_2$, . . . $B_L$ that extend outwardly from the origin of the sound control region. The angular distance $\theta_B$ between each pair of radii boundary lines is equal and corresponds to 360°/L, where L is the number of loudspeakers. In these preferred embodiments, additionally the loudspeakers are located at spaced-apart minimum distances from each other, adjacent walls, and the perimeter of the sound control region by the conditions $l_{spkr}$, $l_{wall}$, and $l_{control}$, which are further discussed below.

In FIG. 7A, a corner-like array configuration is provided with four loudspeakers 12*a*-12*d*. As shown, each loudspeaker 12*a*-12*d* is located in its respective loudspeaker location region $L_1$-$L_4$. As shown, the dotted boundary lines $B_1$-$B_4$ defining the loudspeaker location regions are spaced apart equally by $\theta_B$=90°. This configuration comprises left 12*a* and right 12*b* loudspeakers in front of the listener 15 and two left 12*c* and right 12*d* loudspeaker behind the listener. In a possible modification of the configuration shown, each of the loudspeakers 12*a*-12*d* may be located closer toward a respective corner of the room in a true corner array.

In FIG. 7B, a diamond-like array configuration of four loudspeakers 12*a*-12*d* is shown. The configuration comprises center front 12*a* and rear 12*b* loudspeakers, and also left 12*c* and right 12*d* loudspeakers are located on respective sides of the listener 15. The loudspeaker location regions $L_1$-$L_4$ are similar to those shown in FIG. 7A, except the boundary lines $B_1$-$B_4$ are rotated by about 45°.

In FIG. 7C, an array configuration of five loudspeakers 12*a*-12*e* in the form of a more conventional Dolby-surround-like configuration is shown. With five loudspeakers, five loudspeaker location regions $L_1$-$L_5$ are defined by five boundary lines $B_1$-$B_5$ that are equally spaced by angular distance $\theta_B$=72°. This configuration provides loudspeakers in the following locations: center front 12*a*, left front 12*b*, right front 12*c*, left rear 12*d*, and right rear 12*e*.

As shown in FIGS. 7A-7C, the loudspeakers are positionable in various locations and configurations within their respective loudspeaker location regions and the configuration of the loudspeakers need not necessarily be symmetrical. It will be appreciated that the number of front, rear, and/or side loudspeakers may be increased depending on requirements. As shown, each loudspeaker 12 is located outside the sound control region 11 in each configuration and located or positioned near the walls and/or corners of the room 5 to exploit any reverberation for sound reflections.

Figure 8A:
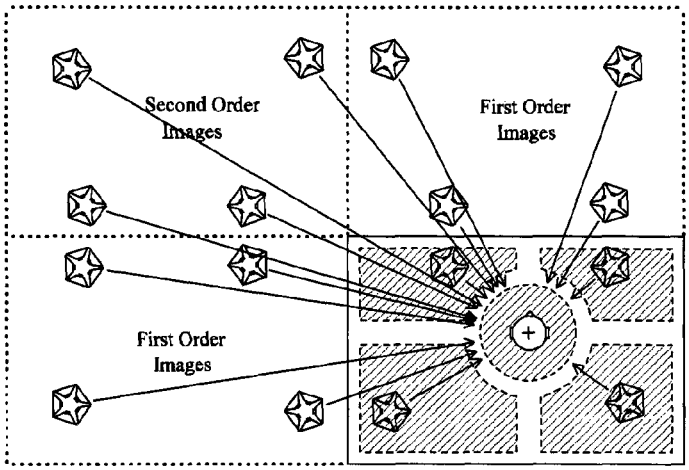
FIGS. 8A-8C are schematic diagrams depicting the first and second order image-sources for the respective loudspeaker arrangements of FIGS. 7A-7C.
Figure 8B:
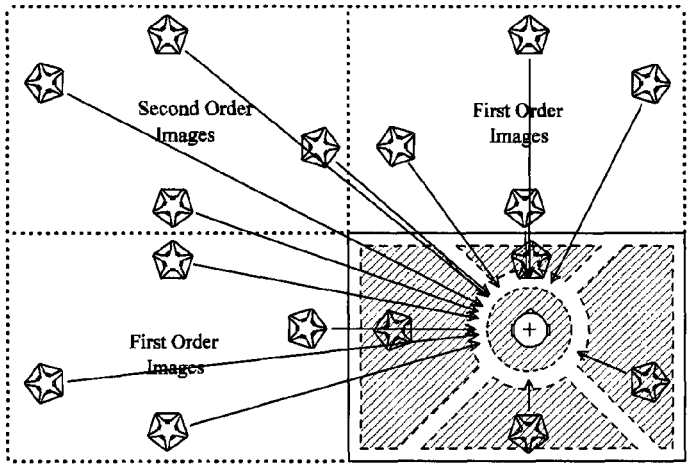
Figure 8C:
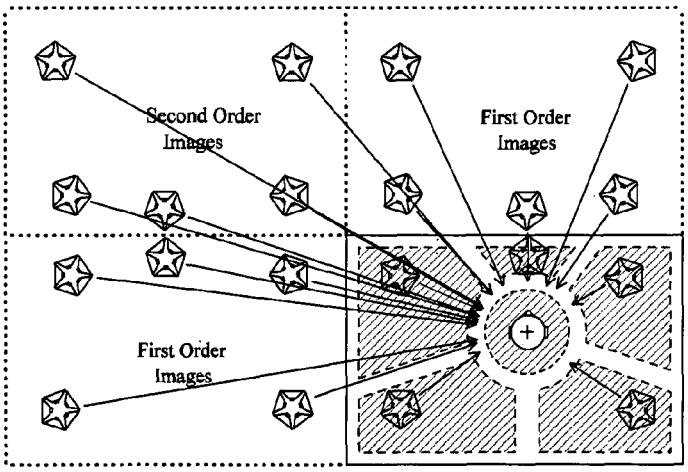

One metric for suitability of a particular loudspeaker array configuration is the range of directions in which the image-sources are positioned. By way of example, FIGS. 8A-8C depicts the first and second order image-sources for the respective configurations of FIGS. 7A-7C. Comparing the range of directions for the four-speaker configurations in FIGS. 8A and 8B shows that obtaining a diverse range of directions is relatively independent of the specific loudspeaker geometry used. However, FIG. 8C shows that increasing the number of loudspeakers to five creates phantom sources in a greater number of directions relative to the four-speaker configurations and is therefore capable of higher performance. By higher performance is meant either (i) creating spatial sound fields in the control region more accurately, or (ii) increasing the size of the sound field we can control.

Statistical room acoustics, where the reverberant sound field is modelled as diffuse, would dictate that for the acoustic transfer functions at different loudspeaker locations to be uncorrelated and hence sufficiently different from each other, the loudspeakers must be located at least half a wavelength λ/2 apart. However at low frequencies, the surround system will tend to control individual room modes. The boundary between the statistical and modal descriptions of room acoustics is given by the Schroeder frequency, which is given by $f_S=2000\sqrt{T_{60}/V}$ where $T_{60}$ is the standard room reverberation time and V is the room volume. Below the Schroeder frequency, the acoustic transfer functions become completely correlated. Hence $l_{spkr}=\lambda_S/2$ and $l_{wall}=\lambda_S/4$ are chosen using $\lambda_S=s_v/f_S$ to ensure the loudspeaker acoustic transfer functions are uncorrelated and hence sufficiently different down to as low a frequency as possible. By way of example, in a living room of dimensions 5 m×4 m×2.5 m with a typical room reverberation time of 500 msec, the Schroeder frequency is 200 Hz. Using the above criteria, the loudspeakers should be spaced at least $l_{spkr}$=86 cm apart and $l_{wall}$=43 cm away from walls.

A reasonable distance of loudspeakers from the centre of the sound control region $l_{control}$ is required to help ensure that the direct sound is not large in comparison to the sound of a reverberant reflection. This condition helps ensure exploiting a reflection for surround sound is robust. The actual distance will depend on both the directivity of the array which is related to loudspeaker order M, and to a lesser extent the strength of wall reflections. Considerations for choosing $l_{control}$ are elaborated on below.

In other embodiments, the geometrical arrangement of the loudspeakers may correspond to the ITU-R BS 775 5.1 Dolby Surround geometry if there are five loudspeakers employed, with a center speaker at 0° in front of the listener in the sound control region, left and right front surround speakers located at +/−22.5-30° and left and right rear surround speakers located at +/−90-110°. Additionally, if seven loudspeakers are employed, the Dolby Surround 7.1 geometry may be employed.

3.3 Number of Loudspeakers and Loudspeaker Order

The requirements on the number loudspeakers L and the directional loudspeaker order M are a function of the radius of the sound control region R and the acoustic frequency f and can be approximately determined from the rule of thumb:

$$L(2M+1)=\frac{4\pi fR}{s_v}+1.$$

To determine the directional loudspeaker order M as a function of R, f and L, this equation can be rearranged to obtain:

$$M=\left\lceil\frac{1}{2L}\left(\frac{4\pi fR}{s_v}+1\right)-\frac{1}{2}\right\rceil,$$

where ⌈x⌉ is the integer ceiling function of x.

To create a control region of a constant size with frequency, the directional loudspeaker order must be stepped up progressively at pre-determined frequency thresholds. By way of example, for a sound control region of radius R=0.2 m, the frequency thresholds for typical choices of the numbers of loudspeakers 12 are shown in Table 1. This table shows that the requirements on loudspeaker order can be reduced by increasing the numbers of loudspeakers 12.

TABLE 1

Threshold frequencies (Hz) to transition to a higher order M of loudspeaker directivity pattern, for different numbers of loudspeakers L for 2-D reproduction in a circular region of radius R of 0.2 m.

| Speaker | No. of Loudspeakers L | | |
|---|---|---|---|
| Order M | 4 | 5 | 7 |
| 1 | 408 | 544 | 816 |
| 2 | 1497 | 1905 | 2722 |
| 3 | 2585 | 3266 | 4627 |
| 4 | 3674 | 4627 | 6532 |
| 5 | 4763 | 5987 | 8437 |
| 6 | 5851 | 7348 | 10342 |
| 7 | 6940 | 8709 | 12247 |
| 8 | 8029 | 10070 | 14152 |

In preferred embodiments, the control unit of the surround sound system is configured to automatically step-up the order of the directivity patterns of the overall directional responses of the loudspeakers as the frequency of the spatial sound field represented by the input spatial audio signals increases to thereby maintain a substantially constant size of sound control region. As shown by the above example, the control unit is preferably configured to step-up the order of the directivity pattern at predetermined frequency thresholds that are predetermined and calculated based on the number of loudspeakers and the desired size of the sound control region.

3.4 Preferable Sound Control Region Size

The diameter 2R of the sound control region cannot be any smaller than the size of the listener's head, and would preferably include both the head and shoulders. On average, the diameter of a human head is accepted to be 0.175 m. Due to the heavy requirements on number of drivers required to perform sound reproduction at high frequencies, the sound control region diameter would typically be no larger than 1 m in most commercial applications, although larger control regions could be provided for as will be appreciated.

3.5 Preferable Room Conditions

The preferable room conditions of the surround sound system are a function of the strength of wall reflections, and the relative lengths of the paths of direct propagation and the reflected propagation path, from loudspeakers 12 to the sound control region. To exploit a reflection, due to the longer propagation distances and the energy absorbed by each wall reflection, the sound directed toward the wall will have to be boosted by the loudspeaker 12 over the levels required for direct sound propagation.

Strong boosting of the sound directed toward the wall reflection however is ill-advised, as such boosting increases the average sound energy levels outside the sound control region [5]. These sound levels may be perceived as unpleasant to a listener standing outside. The external sound levels can be reduced to acceptable levels by appropriate choice of Tikhonov regularization parameter. For good system performance, room conditions must hence be able to ensure the sound energy levels outside are not required to be made significantly larger than those inside the sound control region.

By way of example consider an room with identical reflecting walls of sound energy absorption coefficient $\alpha$. Define $l_{control}$ as the distance of loudspeakers from the sound control region and $l_{mfp}=4V/S$ as the mean free path where V is room volume and S is total room surface area. For an nth order reflection, the propagation distance to the control region is approximately $n\, l_{mfp}$. For 2-D line sources, the loudspeakers energy will have attenuated down to $10 \log_{10}(l_{control}/n\, l_{mfp})$ of the direct sound field energy due to the propagation distance losses, and $10n \log_{10}(1-\alpha)$ due to wall energy absorption. Reflections must hence be boosted by the loudspeaker to counteract this level of attenuation:

$$\text{Boost for } nth \text{ order reflection (dB)} \cong 10\log_{10}\left(\frac{nl_{mfp}}{l_{control}}\right) + 10n\ \log_{10}\left(\frac{1}{1-\alpha}\right).$$

This equation assumes specular reflection only and does not include air absorption losses which are assumed small. For loudspeakers $l_{control}=1$ m away from the sound control region in the 5 m×4 m×2.5 m room (so that $l_{mfp}=2.4$ m) with walls having 50% sound absorption, to exploit $1^{st}$, $2^{nd}$ and $3^{rd}$ order reflections, these reflections must be boosted by 6.7 dB, 13 dB and 18 dB respectively, with the more significant contributor of the attenuation being the greater distance of the higher order reflections from the sound control region. The control unit is configured to boost or amplify the signals relating to the reflected sound to account for wall attenuation. We note that approximate line sources can be built using vertical line arrays or electrostatic loudspeakers. Similar analyses can be applied for 3-D sources, where the dependence of propagation loss on distance l is proportional to $20 \log_{10} l$ instead.

Typically, the system preferably exploits $1^{st}$, $2^{nd}$ and $3^{rd}$ order reflections in rooms with a wall energy absorption coefficient no greater than 75%, and preferably less than 50% to ensure higher order reflections do not require excessive boosting. Due to the distance and wall reflection attenuation aspects, the surround sound system would typically not be configured to exploit reflections beyond $3^{rd}$ order.

Due to the difference in lengths of the propagation paths between the direct sound and higher order reflections, loudspeakers should typically be spaced at least $l_{control}=1$ m away from the center of the sound control region, and preferably more than 1.5 m.

4. Applications

Embodiments of the surround sound system may have the following applications:

- Improved home theatre surround sound,
- High quality surround sound in the home in the form of e.g. higher order ambisonics fields, and
- High end holographic sound systems with a large number of high directivity loudspeakers are appropriate for use in auditoriums.

The system provides these benefits through a surround sound system that employs the use of multiple configurable directional loudspeakers to exploit reverberant reflection in the performing of surround sound. The system employs a sparse array geometry of loudspeakers, with loudspeakers located near the edges or corners of the room, for exploiting the reverberant reflection. The system employs a smaller number of loudspeakers than would be required by a traditional higher order ambisonics system. Further, the surround sound system creates the impression of sound originating from a wall reflection utilising to some extent all loudspeakers, and to not only create the spatial sound impression but also utilise the loudspeakers to cancel at least some of the unwanted reverberation caused by other sound reflections, as the system performs sound field reproduction by means of reverberant compensation.

5. Experimental Example 1

A first experimental example of the surround sound system will be described by way of example and is not intended to be limiting. Like reference numbers in the drawing refer to the same or similar components. In this experimental example of the surround sound system it is shown that using a small number of directionally-controlled loudspeakers, a sound field may be accurately reproduced in a reverberant room. The goal of surround sound is to reproduce a sound field within a control region. Using constructive and destructive interference from the waves emitted from a set of directional loudspeakers, sound field reproduction can be used to create an arbitrary sound field in the control region.

A common objective in surround sound is to place one or more phantom sources around the listener. To place a phantom source at any intended orientation, one would ideally distribute adequate loudspeakers evenly around the listener, with sufficient numbers to avoid spatial aliasing. One such geometry is the uniform circular array (UCA). To meet aliasing requirements in 2-D, at least 2kR+1 loudspeakers are required [19]. However, neither this loudspeaker geometry nor the large numbers of loudspeaker are practical, as both aspects demand a large amount of physical space in the room which carries a low spouse-acceptance-factor.

The surround sound system of the invention reduces the heavy requirements on numbers and arrangement of loudspeakers by using a loudspeaker configuration which exploits room reverberation.

Figure 9:
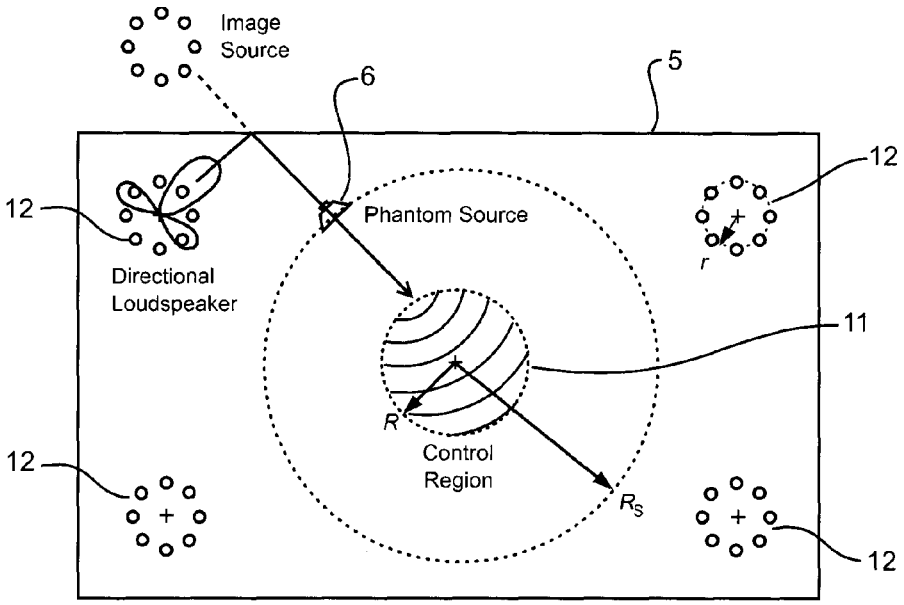
FIG. 9 is a schematic diagram of another geometric arrangement of loudspeakers of the surround sound system about a sound control region in a room in the form of a corner array in accordance with an embodiment of the invention.
Figure 10:
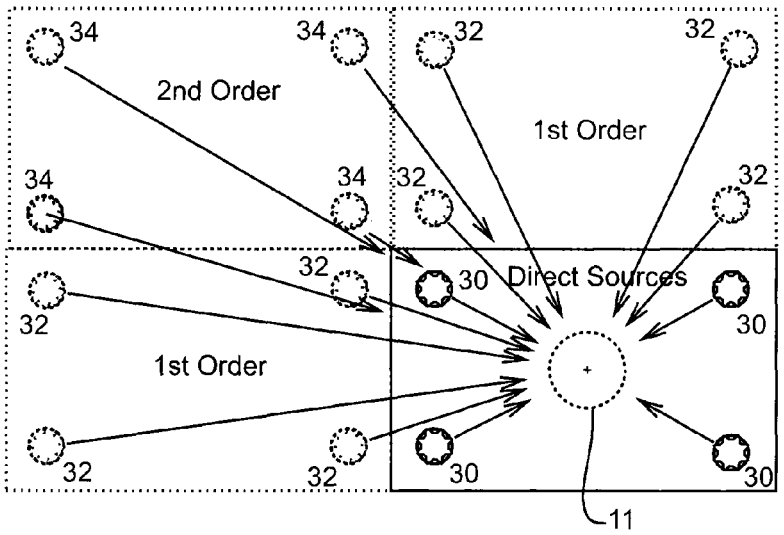
FIG. 10 is a schematic diagram of the corner array surround sound system of FIG. 9 and various possible direct sound and reflected sound waves from the steerable loudspeakers.

Referring to FIG. 9, in this experimental example, it is shown that reverberant reflections can be exploited to enhance the application of surround sound in home theatre. Instead of surrounding the listening area with a UCA of a large number of elements, a sparse set of steerable directional loudspeakers 12 located near the corners of a room 5 could be used (herein a "corner array"). This configuration operates to exploit wall reflections in a typical room which generate the reverberation to produce a large number of virtual loudspeakers locations for creating a phantom source or sources 6. FIG. 9 shows the creation of a virtual sound source 6 from a first order reflection. FIG. 10 shows, by way of example only, a few possible virtual sound source directions available from utilizing direct source (30), the first order reflections (32) and second order reflections (34).

Through exploring the performance of the corner array shown in FIG. 9, it is shown that the surround sound system has a reproduction accuracy and robustness than can be comparable to that of the UCA. An array of four loudspeakers 12, each with a configurable directivity pattern, is used in the experiment. Performance is quantified with the mean square error in the reproduced sound field to indicate accuracy and measure to quantify robustness to perturbation of system parameters.

In this experimental example, we consider reproducing the sound field over a volume of space with a small number L of steerable directional loudspeakers 12. Each configurable directional loudspeaker is realized using an identical array of 2-D monopole elements, so that reverberation can be easily simulated using the image-source method [13]. Here the loudspeakers synthesise directional responses up to approximately M=3$^{rd}$ order. In this experiment, we restrict attention to 2-D reproduction in a room using vertical line sources. The purpose of the steerable loudspeaker approach is to generate additional phantom image directions by creating beams which bounce off reflective walls. Quantitative features of the reverberant sound field are accurately modelled by the image-source method for the case of specular reflection. By exploiting specular reflections, we can improve performance in reverberant environments.

We first overview the pressure matching approach to sound field reproduction. We then describe the approach to modelling the directional loudspeaker.

5.1 Pressure Matching

In the pressure matching approach, one reproduces a desired sound field by matching the pressure at a finite number of points within the sound control region. We shall refer to these points as the matching points. The control region is a circular 2-D region of radius R. To reproduce the desired pressure field $P_s(x;f)$ over the control region using the L directional loudspeakers of D 2-D monopole elements, one needs to satisfy the equation at every point x in the sound control region:

$$\sum_{l=1}^{L}\sum_{d=1}^{D} G_{ld}(f)H(x_q \mid y_{ld}, f) = P_d(x_q \mid f),$$

where $H(x|v_{ld},f)$ is the acoustic transfer function between a monopole driver at $y_{ld}$ and a point x. Pressure matching is performed over a dense grid of Q' matching points $\{x_1, \ldots, x_{Q'}\}$ located within the control region. The set of equations required to be satisfied can be manipulated into the matrix-vector form $$Hg=p_d$$

where $[H]_{q(Dl+d)}=H(x_q|y_{ld},f)$ is a matrix of acoustic transfer functions, $[g]_{Dl+d}=G_{ld}(f)$ is a vector of loudspeaker weights and $[p_d]_q=P_d(x_q|f)$ is a vector of desired pressures at the matching points. The loudspeaker weights g required to achieve a small mean square error robustly can be calculated through the regularized least squares solution:

$$g=[H^H H+\lambda I]^{-1}H^H p_d \tag{6}$$

where λ is the Tikhonov regularization parameter. A class of desired pressure fields that shall be reproduced here is the 2-D phantom monopole source:

$$P_d(x|f)=P_0 H_0^{(2)}(k\|x-R_s\phi_s\|),$$

where $R_s$ is phantom source radius, $\phi_s=[\cos\phi_s, \sin\phi_2]^T$, $\phi_s$ is the orientation angle of the phantom source and $P_0$ is a pressure amplitude constant.

For accurate sound field reproduction over a circular 2-D region of radius R, the number of monopoles required at wavenumber k [15] is:

$$L'=2kR+1 \tag{7}$$

This number corresponds to the number of spatial modes active within the control region.

5.2 Directional Loudspeaker Design

A directional loudspeaker can be modelled with an Mth order directivity pattern. The far-field directivity pattern $D_l(\phi|f)$ at frequency f can be written as the phase mode expansion:

$$D_l(\phi \mid f) = \sum_{m=-M}^{M} \alpha_{ml}(f)e^{im\phi}$$

where $\alpha_{ml}(f)$ are the weighting coefficients for the mth order phase mode. Each directional loudspeaker is realized by arranging a number D of monopoles drivers into a uniform circular array of radius r. To ensure loudspeaker responses up to Mth order are obtainable, one designs each monopole array choosing r=M/k and D≥2M+1 as described above. Here we ensure the directional loudspeakers are designed to achieve second order directivity responses. The monopole weights are then chosen according to regularized least squares to suit the sound field reproduction problem.

The near-field directivity pattern $D_l(\phi|f)$ of each configurable directional loudspeaker l that results from the above pressure matching design is:

$$D_l(\rho, \phi \mid f) = \sum_{d=1}^{D} G_{ld}(f)H_0^{(2)}(k\|r\varphi_d - \rho\varphi\|)$$

where ρ is the distance from the centre of the uniform circular array of the loudspeakers, φ the angle made with the x-axis, $\phi=[\cos\phi, \sin\phi]^T$, $\phi_d=[\cos\phi_d, \sin\phi_d]^T$ and $\phi_m$ is the orientation angle of each loudspeaker m.

5.3 Pressure Matching with a Uniform Circular Array

For comparison in this experiment, we shall also reproduce the sound field with L'=LD acoustic monopoles arranged into a uniform circular array. Matching the pressure over Q' points inside the sound control region, the loudspeaker weights are again obtained through the regularized least squares solution in equation (6) where instead $[H]_{ml}=H(x|y_l,f)$ is now the acoustic transfer function between a monopole at located at $y_l$ in the UCA and a point sensor at x.

5.4 On Robust Design

We briefly discuss aspects which contribute to the robustness of a surround sound system. The way the robustness is quantified is through the loudspeaker weight energy $\|g\|^2$. The white noise gain [17, p. 69], quantifies the ability of a loudspeaker array to suppress spatially uncorrelated noise in the source signal. The major errors such as those in the amplitude and phase of the acoustic transfer functions and loudspeaker position errors are nearly uncorrelated and affect the signal processing in a manner similar to spatially white noise [18]. As the loudspeaker weight energy is inversely proportional to the white noise gain, it provides a relative measure of the reaction to such errors.

We examine the factors affecting robustness with aid of the singular value decomposition (SVD). In the case $L' \leq M$, the SVD of the acoustic transfer function matrix H can be written:

$$H = \sum_{n=1}^{L'} \sigma_n u_n v_n^H$$

where $u_n$ are the orthonormal output vectors of the sound fields reconstructible by H, $v_n$ are the orthonormal input vectors of loudspeaker weights and $\sigma_n$ are the singular values of matrix H describing the strength of the sound field created by each loudspeaker weight $v_n$. We shall assume singular values are ordered $\sigma_1 > \sigma_2 > \ldots > \sigma_{L'}$. After substituting the SVD of H into equation (6), the loudspeaker weights can be shown to be:

$$g = \sum_{n=1}^{L'} \frac{\sigma_n}{\sigma_n^2 + \lambda} c_n v_n,$$

where $c_n = u_n^H p_d$ is the projection of $p_d$ on the subspace of sound fields reconstructable by H.

A straight-forward way of improving robustness is to increase the Tikhonov regularization parameter λ. The loudspeaker weight energy can be shown to be:

$$\|g\|^2 = \sum_{n=1}^{L'} \left( \frac{\sigma_n}{\sigma_n^2 + \lambda} \right)^2 |c_n|^2,$$

which is inversely related to λ. It is largest if we choose a vector as the sound field $g = u_{L'}$ with the smallest singular value, where loudspeaker weight energy is equal to $\sigma_{L'}^2(\sigma_{L'}^2 + \lambda)^2$. Increasing λ however reduces the size of the loudspeaker weight energy at the expense of performance.

In contrast, manipulating the acoustic environment's geometry so that the desired sound field $p_d$ projects onto only the reconstructable sound fields $u_n$ having large singular values $\sigma_n$ would also improve robustness. Robustness can be improved by:

- choosing a loudspeaker array geometry which couple strongly the principal components of the acoustic transfer function matrix to the desired set of sound fields. One way to do this is to place a loudspeaker in-line with the desired phantom source;
- changing the acoustic sound environment to achieve the same ends. One way is to introduce reverberation to create an image-source in-line with the desired phantom source.

As illustrated by the arrows 32 and 34 in FIG. 10, first and second order reflections greatly increase the range of directions a phantom can be placed. There appears good scope for improving performance by exploiting these reflections.

In the case of the array of directional loudspeakers, the loudspeaker weight energy includes a component attributable to the ease of realizing the directional patterns with the D monopole drivers. The measure hence relies on the directional loudspeaker being properly designed, which will be the case if the number and geometry of the monopoles are chosen correctly for the design frequencies.

5.5 Results and Discussion

In this experiment, we demonstrate typical performance of a surround sound system with L=4 smart loudspeakers and 8 drivers in each configurable loudspeaker simulating performance at 500 Hz. The loudspeakers 12 were arranged in a corner array in a room 5 as shown in FIG. 9.

We compared performance of the corner array with a uniform circular array (UCA) in a 6.4×5 m room under different reverberant conditions (cases):

1. anechoic chamber,
2. a single (north) wall only with reflection coefficient γ=0.9,
3. all wall reflection coefficients set to γ=0.9 and
4. the same room with coefficients γ=[0.4, 0.8, 0.2, 0.6].

The array geometries being compared are summarized as:

A corner array consisting of L=4 smart configurable loudspeakers, each composed of D=8 drivers (monopole sources) arranged into a uniform circular array of radius r=0.2 m, which can robustly generate accurate second order loudspeaker responses (and allow creation of up to $3.5^{th}$ order directivity patterns). Each of the smart loudspeakers was placed in a corner of the room at 1.5 m from both walls.

An uniform circular array (UCA) consisting of LD=32 drivers were arranged into an uniform circular array at $R_s$=2 m from the centre of the sound control region.

The sound control region 11 was located at the centre of the room 5 with a radius of R=0.5 m. We positioned the loudspeakers of the corner array away from the walls to increase the range of directions that can be attained from low order reverberant reflections.

Room reverberation was simulated using a 2-D implementation of the image-source method [13], with acoustic transfer functions computed using:

$$H(x_q, y_l \mid f) = \sum_{i=1}^{\infty} \xi_i H_0^{(2)}(k\|x_q - y_l^{(i)}\|),$$

where $\xi_i$ denote the accumulated reflection coefficient for the ith image-source and $y_l^{(i)}$ the position of the ith image-source of monopole l, truncating the impulse responses to the $T_{30}$ reverberation time. The $T_{30}$ reverberation times are 530 msec and 100 msec for reverberant rooms 3 and 4 respectively. Sound field reproduction was carried out using the regularized pressure matching in with Tikhonov regularisation parameter λ=0.1 to create a 2-D monopole phantom source at 2 m from the centre of the control region. Due to the symmetry in the room geometry, it was sufficient to pan the phantom source angle over a 90° angular range.

We compare the performance of the corner array with that of an UCA of 32 loudspeakers in reverberant room case 3. For a 0.5 m control region radius, only 11 monopoles are required by (7) at 500 Hz, so there are a number of additional degrees of freedom with which to perform the reproduction. These degrees of freedom are not wasted, as adding loudspeakers above the Nyquist sampling requirements improves the robustness.

Figure 11A:
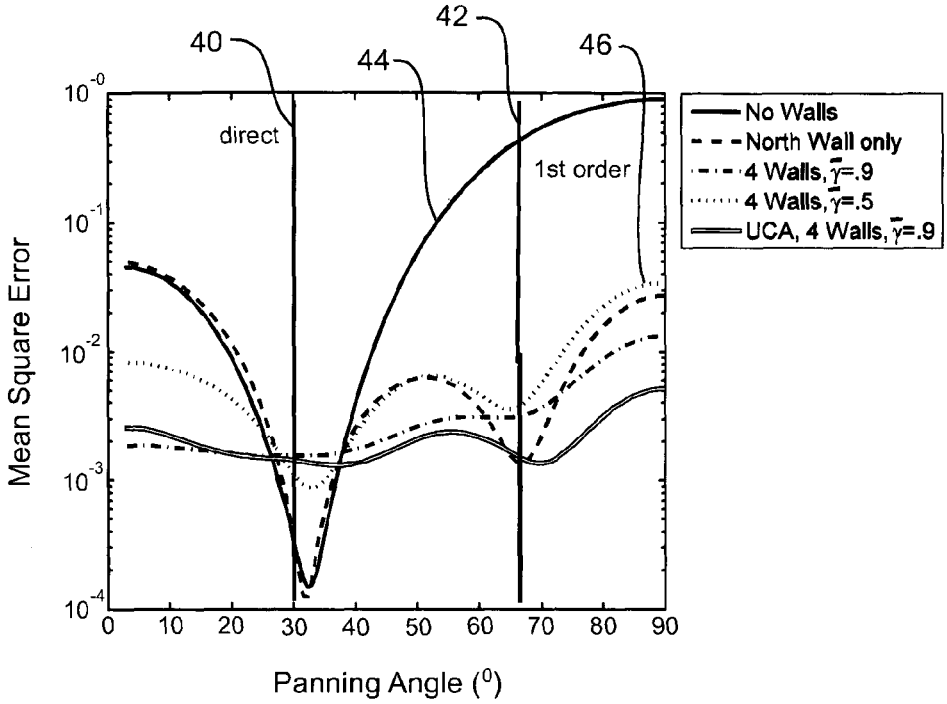
FIGS. 11A and 11B show graphical representations of mean square error and loudspeaker weight energy respectively against panning angle for a performance comparison between a conventional uniform circular array of loudspeakers and a corner array surround sound system in accordance with an embodiment of the invention.
Figure 11B:
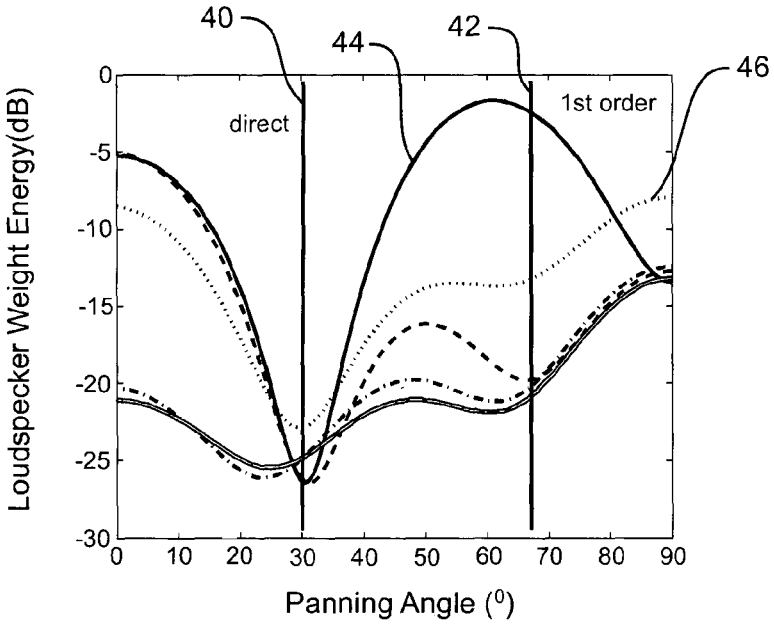

FIGS. 11A and 11B show a performance comparison between the corner array and UCA as a function of panning angle for a virtual source at 2 m. The MSE is shown in FIG. 11A and the loudspeaker weight energy is shown in FIG. 11B. Directions to the loudspeaker and first and second order image-sources are as marked. The plots clearly show that one or more wall reflections improves the reproduction performance of the corner array by up to two orders of magnitude above anechoic room conditions. Marked with vertical lines are the direct sound direction 40 and the most dominant reflection 42.

The MSE reproduction performance of the corner array in several acoustic environments is shown in FIG. 11A, where we study the effect of adding one or more reflective walls to the room. In the anechoic environment, the corner array performs poorly when panning angles away from the directional loudspeakers as shown by curve 44. One or more strong reflections however improves the sound field reproduction performance of the corner array configuration, by up to two orders of magnitude. The corner array compares favourably with the uniform circular array. Both configurations perform with an error in the range $10^{-2}$ to $10^{-3}$, except in the cases of sound propagating from either the north or east walls. Recreating a phantom sound propagating from the north wall ($\phi_s$=90°) is the most difficult, as the loudspeaker image-sources are furthest away from this phantom source direction.

Marked on FIGS. 11A and 11B also are angles of the direct source and most significant first order image. The MSE in the direction of the first order image at 67° is good; it almost matches the performance of placing the phantom source in-line with a directional loudspeaker at 30°. The loudspeaker array here is clearly exploiting the reverberant reflection to improve MSE. The first order image of the bottom-right directional loudspeaker beyond the bottom wall produces the most impact here, pulling down the MSE by two orders of magnitudes below the anechoic case at 67°.

Higher order images also contribute to improving MSE performance. In FIG. 11A the MSE is lower in the four wall cases than for the single wall and anechoic case. First order reflections are the easiest to exploit. Higher order images however, being further away from the control region, produce reflections that are diminished in amplitude. These reflections would be more difficult to exploit robustly than first order reflections, and neither is their impact on the MSE performance as dramatic.

The level of performance is dependent upon the strength of reverberant reflections. Reducing the strength of reverberant reflections decreases performance. The dotted curve 46 in FIG. 11A, where the average reflection coefficient is reduced from 0.9 to 0.5, shows a performance that is slightly degraded. There appears to be an optimal choice of wall reflection coefficient. If wall reflection coefficients are too weak, then exciting a wall reflection becomes difficult. However, if they are too strong, then exciting a first order reflection is not possible without also exciting much higher order reflections. Higher order reflections are more susceptible to perturbation.

Figure 12A:
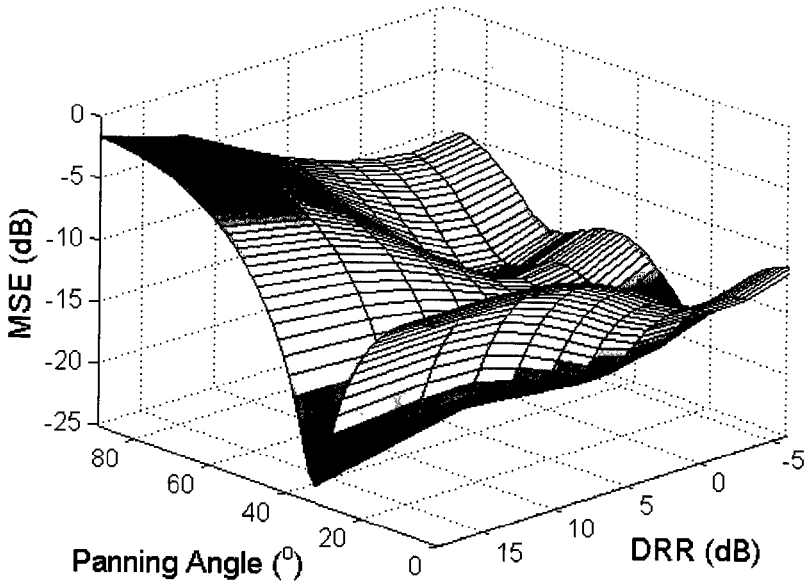
FIGS. 12A and 12B show graphical representations of mean square error against phantom panning angle and direct-to-reverberant ratio (DRR) for performance comparison between a convention uniform circular array of loudspeakers and a corner array of the surround sound system in accordance with an embodiment of the invention respectively.
Figure 12B:
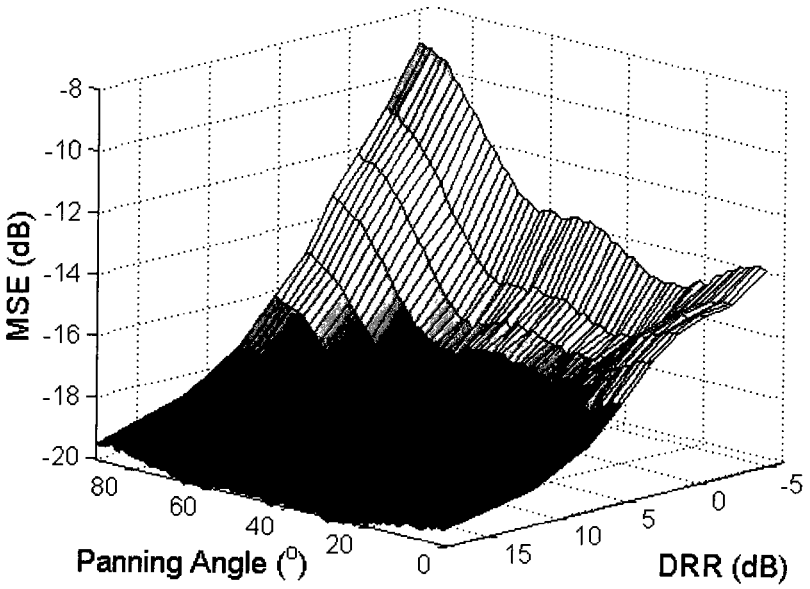

FIGS. 12A and 12B show the mean square error (MSE) performance of (a) a 32 element uniform circular array and (b) the four element corner array of directional loudspeakers in reproducing a phantom source at 500 Hz. MSE is plotted against both phantom panning angle and direct-to-reverberant-ratio (DRR). −20 dB of white Gaussian noise has been added to each element of the matrix of acoustic transfer functions.

FIGS. 12A and 12B show how the level of the performance varies with direct-to-reverberant energy ratio as wall reflection coefficient varies from 0.1 to 0.9. These plots corroborate the hypothesis that there is an optimal reverberation level. Here we introduced −20 dB of noise into the acoustic transfer function matrix H to emulate imperfect acoustic transfer function measurement. Both the circular array and the corner array perform very similar at −6 dB reverberation. The raised curves for the circular array in FIG. 12A at 0° and 90° are remnants of the degeneracy of the symmetrical room geometry.

Figure 13:
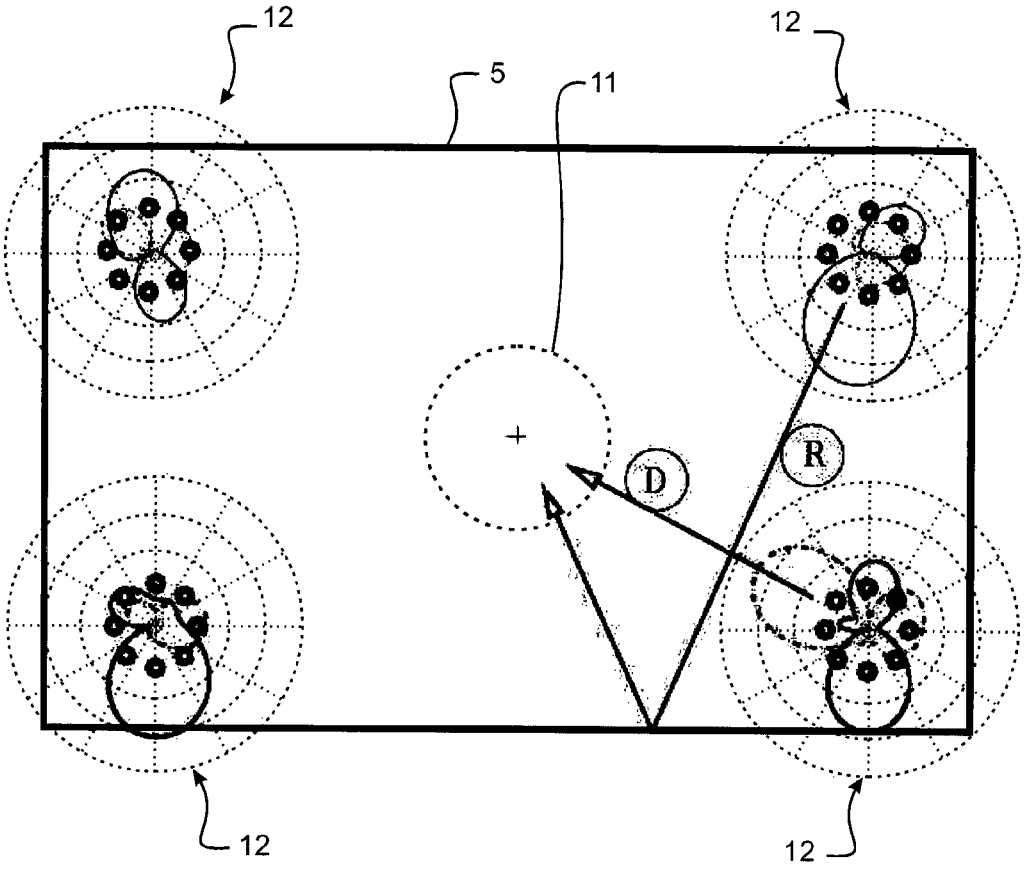
FIG. 13 shows a schematic diagram of the beampatterns required from the loudspeakers in a corner array geometric configuration of the surround sound system to place a phantom source in-line with a direct ray D and in-line with a reflected ray R.

In regard to beampatterns, the directional loudspeaker corner array performance is best when the phantom source is in-line with either a loudspeaker or a low order reflection. By way of example, phantom sources are placed in directions of D and R illustrated in FIG. 13 in room 5 case 3. More particularly, FIG. 13 illustrates the beampatterns required of all four corner loudspeakers to place a phantom source in-line with direct ray D at $\theta_s(D)=-30.5°$ (dotted beampatterns) and in line with reflected ray R of the top-right loudspeaker $\theta_s(R)=-74.2°$ (solid beampatterns) at a radius of 2 m. The beampatterns for the four steerable loudspeakers 12 are shown at the four corners of the room. For both cases, the beampatterns exhibits a non-trivial structure but possess the properties: (i) a large main lobe in the phantom source direction for the loudspeaker whose image is in-line with the phantom source, and (ii) several other lobes used to cancel the reverberation created from other reflections. The main lobe may be obscured by the reverberation-cancelling lobes if the reproduction is not sufficiently regularized. Here we used a larger regularization parameter $\lambda$=0.5 to ensure the main lobe is visible.

5.6 Summary

This experiment tested an approach to surround sound for exact sound field reproduction in a reverberant room by utilizing steerable loudspeakers with configurable directional responses. An array of four configurable steerable loudspeakers with roughly second order directivity was shown to possess a reproduction performance comparable with a much larger circular array of loudspeakers, by exploiting the wall reflections in a reverberant room. The level of performance was seen to be dependent on the strength of specular reflections. For optimal performance the room was seen to require strong wall reflections.

The pressure matching method in practise relies upon measurement of the acoustic transfer functions from each loudspeaker to a number of points in the sound control region. The approach must be made robust to error in these measurements and can be made robust through regularization.

A preliminary study of performance was presented using a corner array geometry for the smart loudspeakers. Other geometries also show potential, including a diamond and pentagon, and others. Although some geometries perform better than others for generating certain sound fields, the geometry studied here demonstrates the key features of using multiple steerable directional loudspeakers to exploit reverberation.

6. Experimental Example 2

In this experimental example, a simulation of the surround sound system employing a 4 smart loudspeaker 12 corner array can generate a 1 kHz acoustic pulse propagating into the sound control region from an angle of 45 degrees.

Figure 14:
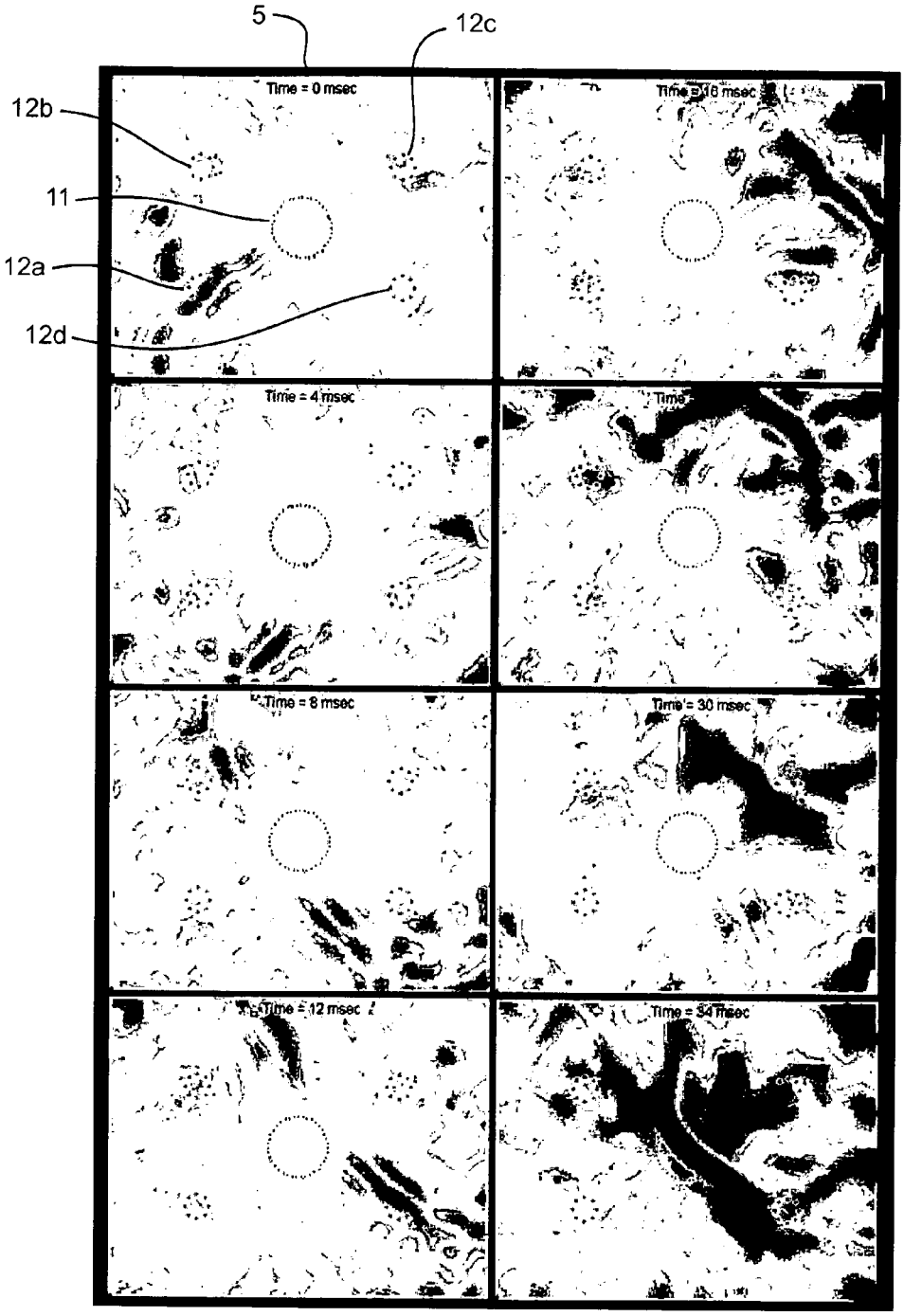
FIG. 14 shows screen shots of wave propagation generated by a corner array surround sound system for generating a sound wave propagating into the sound control region from an angle of 45° in the plane.

FIG. 14 demonstrates how a small number of smart loudspeakers 12 can control the sound field in the sound control region 11 within a reverberant room 5. It shows how we can create a 1 kHz acoustic pulse inside the control region 11 without reverberation from reflections. In this simulation, a surround sound system of a corner array of four smart loudspeakers 4 (each comprising eight drivers or elements) has been set the task of creating the acoustic pulse to propagate into the sound control region at 45°.

To create the spatial sound pulse, the array first excites the bottom-left "smart" loudspeaker 12*a* at 0 msec which then bounces off the bottom wall at 4-8 msec. The bottom-right loudspeaker 12*d* adds some to the initial sound energy as it propagates past at 12 msec, before switching to the top-right loudspeaker 12*c* to contribute more energy to the wavefront at 16 msec. The wavefront then bounces off the right and top walls at 26 msec to again propagate past the top-right loudspeaker 12*c* which contributes more sound energy at 26-30 msec. After constructing the 45 degree wavefront in the sound control region at 34 msec, the four smart loudspeakers then antiphase the propagating sound to reduce its intensity and so ensure that no further reverberation reaches the control region.

The foregoing description of the invention includes preferred forms thereof. Modifications may be made thereto without departing from the scope of the invention as defined in the accompanying claims.

7. References

The following disclosure in the following documents is herein incorporated by reference.

[1] Mark A. Poletti, "Effect of noise and transducer variability on the performance of circular microphone arrays," *Journal of the Audio Engineering Society*, Vol. 53, No. 5, pp. 371-384, May 2005.

[2] Mark Poletti, *Microphone Arrays for High Resolution Sound Field Recording*, U.S. Pat. No. 2,373,128, January 2004.

[3] Paul D. Teal and Mark A. Poletti, "Adaptive phase calibration of a microphone array for acoustic holography," *J. Acoustic Soc. Am.*, Vol. 127, No. 4, pp 2368-2376, May 2010.

[4] Terence Betlehem and Thushara D. Abhayapala, "Theory and Design of Sound Field Reproduction in Reverberant Rooms," *J. Acoustic Soc. Am*, Vol. 117, No. 4, pp. 2100-2111, April 2005.

[5] M. Poletti, F. Fazi and P. A. Nelson, "Surround sound systems using directional loudspeakers," *J. Acoust. Soc. Am.*, Vol. 127, No. 3590, 2010.

[7] Sacha Spors, Herbert Buchner and Rudolf Rabenstein, "Efficient active listening room compensation for wave field synthesis," *Proceedings of the* 116$^{th}$ *Audio Engineering Convention*, Berlin, May 8-11, 2004.

[8] Philippe-Aubert Gauthier, Alain Berry, "Adaptive wave field synthesis for sound field reproduction: theory, experiments and future perspectives," *Proceedings of the* 123$^{rd}$ *Audio Engineering Convention*, Oct. 5-8, 2007.

[9] Gerzon, Michael A., "Ambisonics in Multichannel Broadcasting and Video," *Journal of the Audio Engineering Society*, Vol. 33, No. 11, pp. 859-871, 1985.

[10] Chapman, Michael, et. al, A Standard for Interchange of Ambisonic Signal Sets, Ambisonics Symposium 2009, Graz, Jun. 25-37, 2009.

[11] M. Poletti, "Unified Description of Ambisonics using Real and Complex Spherical Harmonics," *Proceedings of the Ambisonics Symposium* 2009, Graz, Jun. 25-37, 2009

[13] Allen, J. and D. Berkley, "Image method for efficiently simulating small-room acoustics," *Journal of the Acoustical Society of America*, vol 65, no. 4, pp. 943-950, 1979.

[14] Terence Betlehem and Mark Poletti, "Sound field reproduction around a scatterer in reverberation," *Proceedings of the International Conference on Acoustics Speech and Signal Processing*, pp. 89-92, 2009.

[15] Poletti, M. A., "A Unified Theory of Horizontal Holographic Sound Systems," *Journal of the Audio Eng. Soc.*, Vol. 48, No. 12, 2000.

[16] Ward, D. B. and T. D. Abhayapala, "Reproduction of a plane-wave sound field using an array of loudspeakers", *IEEE Trans. Speech and Audio Processing*, Vol. 9, No. 6, pp. 697-707, 2001.

[17] Van Trees, H. L., *Detection, Estimation, and Modulation Theory: Optimum Array Processing*, New York: John Wiley and Sons, 2002.

[18] Cox, H., R. M. Zeskind, and T. Kooij "Practical Supergain," *IEEE Transactions on Acoustics, Speech, and Signal Processing*, Vol. ASSP-34, No. 3, 393-398, 1986.

[19] Ward, D. B. and T. D. Abhayapala, "Reproduction of a plane-wave sound field using an array of loudspeakers", *IEEE Trans. Speech and Audio Processing*, Vol. 9, Issue 6, pp. 697-707, 2001.

[20] Boon, M. M and O. Ouweltjes, "Design of a Loudspeaker System with a Low-Frequency Cardioid Radiation Pattern," *Journal of the Audio Eng. Soc.*, Vol. 45, No. 9, 1997.

[21] Fuster, L. et al. (2005). "Room compensation using multichannel inverse filters for wave field synthesis systems". *Proc.* 118*th Convention of the AES*, preprint 6401.

[22] Spors, S. et al. (2007). "Active listening room compensation for massive multichannel sound reproduction systems using wave-domain adaptive filtering," *Journal of the Acoustical Society of America*, Vol 122, No. 1, pp. 354-369.

[23] M. A. Poletti, "Three-dimensional surround sound systems based on spherical harmonics," *Journal of the Audio Eng. Soc.*, Vol. 53., No. 11, pp. 1004-1025, 2005.

[24] Gauthier, P-A. and A. Berry, "Adaptive wave field synthesis for sound field reproduction: theory, experiments and future perspectives," J. Audio Engin. Soc., Vol. 55, No. 12, pp. 1107-1124, 2007.

The invention claimed is:

1. A surround sound system configured to produce a spatial sound field in a sound control region within a room having at least one sound reflective surface, comprising:

multiple steerable loudspeakers located about the sound control region, each loudspeaker configured to receive a plurality of speaker input signals, each speaker input signal controlling one of a plurality of different individual directional beam response patterns which may be generated by the loudspeaker, and wherein the overall directional response of the sound waves emanating from the loudspeaker is that created by a combination of the individual directional beam response patterns as dictated by the speaker input signals; and a control unit connected to each of the loudspeakers and which in a playback mode receives input spatial audio signals representing a spatial sound field for production in the sound control region, the control unit having preconfigured filters for filtering the input spatial audio signals to generate the speaker input signals for driving the loudspeakers to generate sound waves with respective overall directional responses that are co-ordinated to combine together at the sound control region to produce the spatial sound field in the form of direct sound emanating into the sound control region directly from one or more loudspeakers and reflected sound emanating into the sound control region from the reflective surface(s) of the room, the filters of the control unit being pre-configured in a configuration mode prior to operating in playback mode based on acoustic transfer function data measured by a sound field recording system comprising a microphone array located in the sound control region and where the acoustic transfer function data represents the acoustic transfer functions measured by the microphone array in response to test signals generated by each of the loudspeakers for each of their individual directional beam response patterns at their respective locations in the room.

2. A surround sound system according to claim 1 wherein the input spatial audio signals are in an ambisonics-encoded surround format that is received and directly filtered by the filters in the control unit to generate the speaker input signals for the loudspeakers.

3. A surround sound system according to claim 1 wherein the input spatial audio signals are in a non-ambisonics surround format and the control unit further comprises a converter that is configured to convert the non-ambisonics input signals into an ambisonics surround format for subsequent filtering by the filters in the control unit to generate the speaker input signals for the loudspeakers.

4. A surround sound system according to claim 1 wherein the control unit is switchable between the configuration mode in which the control unit configures the filters for the room and the playback mode in which the control unit processes the input spatial audio signals for production of the spatial sound field using the loudspeakers, and wherein the control unit comprises a configuration module that is arranged to automatically configure the filters in the configuration mode based on input acoustic transfer function data for the room that is measured by the sound field recording system.

5. A surround sound system according to claim 4 wherein the configuration module receives raw measured acoustic transfer function data from the sound field recording system and converts it into an ambisonics representation of the acoustic transfer function data which is used to configure the filters of the control unit.

6. A surround sound system according to claim 1 wherein the filters of the control unit are ambisonics loudspeaker filters.

7. A surround sound system according to claim 1 wherein the surround sound system is configured to provide a 2-D spatial sound field production in a 2-D sound control region, and wherein the sound control region is circular and has a predetermined diameter.

8. A surround sound system according to claim 7 wherein the sound control region is located in a horizontal plane and the loudspeakers are at least partially co-planar with the sound control region.

9. A surround sound system according to claim 1 wherein each loudspeaker is located within a respective loudspeaker location region, the room being radially and equally segmented into loudspeaker location regions about the origin of the sound control region based on the number of loudspeakers, and wherein each loudspeaker region is defined to extend between a pair of radii boundary lines extending outwardly from the origin of the sound control region, and wherein the angular distance between each pair of radii boundary lines corresponds to 360°/L, where L is the number of loudspeakers.

10. A surround sound system according to claim 1 wherein each loudspeaker is spaced apart from every other loudspeaker by at least half of a wavelength of the Schroeder frequency of the room within which the surround sound system operates.

11. A surround sound system according to claim 1 wherein each loudspeaker is spaced apart from any reflective surface(s) in the room by at least quarter of a wavelength of the Schroeder frequency of the room within which the surround sound system operates.

12. A surround sound system according to claim 1 wherein each loudspeaker is spaced at least 1 m from the center of the sound control region.

13. A surround sound system according to claim 12 wherein each loudspeaker is spaced at least 1.5 m from the center of the sound control region.

14. A surround sound system according to claim 1 wherein each loudspeaker is configured to generate overall directional responses having up to $M^{th}$ order directivity patterns, where M is at least 1, and wherein the value of 2M+1 corresponds to the number of individual directional beam response patterns available for each loudspeaker.

15. A surround sound system according to claim 14 wherein each loudspeaker is configured to generate overall directional responses having upto $M^{th}$ order directivity patterns, wherein M is equal to 4.

16. A surround sound system according to claim 14 wherein each loudspeaker comprises at least an individual directional beam response patterns corresponding to a first order directional response.

17. A surround sound system according to claim 14 wherein each loudspeaker comprises at least individual directional beam response patterns corresponding to 2M+1 phase mode directional responses.

18. A surround sound system according to claim 14 wherein each loudspeaker comprises at least individual directional beam response patterns corresponding to an omni-directional response, and $\cos(m\phi)$ and $\sin(m\phi)$ for m=1, 2, . . . , M, and where $\phi$ is equal to the desired angular direction of the loudspeaker overall directional response relative to the origin of the loudspeaker.

19. A surround sound system according to claim 1 wherein the overall directional response of each loudspeaker is steerable in 360° relative to the origin of the loudspeaker.

20. A surround sound system according to claim 1 wherein each loudspeaker comprises multiple drivers configured in a geometric arrangement with in a single housing, each driver being driven by a driver signal to generate sound waves, and wherein each loudspeaker further comprises a beamformer module that is configured to receive and process the speaker input signals corresponding to the individual directional beam response patterns of the loudspeaker and which generates driver signals for driving the loudspeaker drivers to create an overall sound wave having the desired overall directional response.

21. A surround sound system according to claim 1 wherein each loudspeaker comprises a housing within which a uniform circular array of monopole drivers of a predetermined radius are mounted, and wherein the number of drivers and radius is selected based on the desired maximum order of directivity pattern required for the loudspeaker, and wherein the monopole drivers are spaced apart from each other by no more than half a wavelength of the maximum frequency of the operating frequency range of the surround sound system.

22. A surround sound system according to claim 1 comprising at least four steerable loudspeakers.

23. A surround sound system according to claim 1 wherein the loudspeakers are equi-spaced relative to each other about the sound control region.

24. A surround sound system according to claim 1 wherein the spatial sound field is represented in the sound control region by direct sound in combination with first order, second order, and/or higher order reflections from sound waves reflected off one or more reflective surfaces of the room.

25. A surround sound system according to claim 1 wherein the surround sound system is configurable to produce higher order ambisonics spatial sound fields.

26. A surround sound system according to claim 1 wherein the diameter of the sound control region is in the range of about 0.175 m to about 1 m.

27. A surround sound system according to claim 1 wherein the surround sound system is configured to provide a 3-D spatial sound field production in a 3-D sound control region, and wherein the 3-D sound control region is spherical in shape.

28. An audio device for driving multiple steerable loudspeakers to produce a spatial sound field in a sound control region, each loudspeaker having a plurality of different individual directional beam response patterns being controlled by respective speaker input signals to generate sound waves emanating from the loudspeaker with a desired overall directional response created by a combination of the individual directional beam response patterns as dictated by the speaker input signals, and where the loudspeakers are located about a sound control region in a room having at least one sound reflective surface, the device comprising:

an input interface for receiving input spatial audio signals representing a spatial sound field for production in the sound control region;

a filter module comprising filters that are configurable based on acoustic transfer function data representing the acoustic transfer functions measured by a sound field recording system comprising a microphone array located in the sound control region and where the acoustic transfer function data represents the acoustic transfer functions measured by the microphone array in response to test signals generated by each of the loudspeakers for each of their individual directional beam response patterns at their respective locations in the room, and wherein the filters filter the input spatial audio signals to generate speaker input signals for driving the loudspeakers to generate sound waves with respective overall directional responses that are co-ordinated to combine together at the sound control region to produce the spatial sound field in the form of direct sound emanating into the sound control region directly from one or more of the loudspeakers and reflected sound emanating into the sound control region from the reflective surface(s) of the room; and an output interface for connecting to all the loudspeakers and for sending the speaker input signals to the loudspeakers.

29. An audio device according to claim 28 comprising wherein the input interface is configured to receive input spatial audio signals in an ambisonics-encoded surround format for direct filtering by the filters of the filter module to generate the speaker input signals for the loudspeakers.

30. An audio device according to claim 28 wherein the input interface is configured to receive input spatial audio signals in a non-ambisonics surround format and which further comprises a converter that is configured to convert the non-ambisonics input signals into an ambisonics surround format for subsequent filtering by the filters of the filter module to generate the speaker input signals for the loudspeakers.

31. An audio device according to claim 28 wherein the device is switchable between a configuration mode in which the device configures the filters of the filter module for the room and a playback mode in which the device processes the input spatial audio signals for production of the spatial sound field using the loudspeakers, and wherein the device further comprises a configuration module that is arranged to automatically configure the filters of the filter module in the configuration mode based on input acoustic transfer function data for the room that is measured by the sound field recording system.

32. An audio device according to claim 31 wherein the configuration module receives raw measured acoustic transfer function data from the sound field recording system and converts it into an ambisonics representation of the acoustic transfer function data which is used to configure the filters of the filter module.

33. An audio device according to claim 28 wherein the filters of the filter module are ambisonics loudspeaker filters.

* * * * *